US007065987B2

(12) United States Patent
Henneberg

(10) Patent No.: US 7,065,987 B2
(45) Date of Patent: Jun. 27, 2006

(54) HAND CRAFTED AFGHAN INCORPORATING PERSONALIZED OR COMMEMORATIVE INDICIA AND METHOD OF FABRICATING SAME

(76) Inventor: Leslie Howe Henneberg, 375 Eatontown Rd., Port Jervis, NY (US) 12771

( * ) Notice: Subject to any disclaimer, the term of this patent is extended or adjusted under 35 U.S.C. 154(b) by 299 days.

(21) Appl. No.: 10/699,285

(22) Filed: Oct. 31, 2003

(65) Prior Publication Data

US 2005/0115483 A1 Jun. 2, 2005

(51) Int. Cl.
*D04B 31/00* (2006.01)

(52) U.S. Cl. ..... 66/1 R; 66/170

(58) Field of Classification Search ..... 66/1 R, 66/170, 169 R

See application file for complete search history.

(56) References Cited

U.S. PATENT DOCUMENTS

| | | | | |
|---|---|---|---|---|
| 1,197,551 A | | 9/1916 | Schmidt | |
| D121,954 S | * | 8/1940 | Gorska | D6/603 |
| 2,299,300 A | * | 10/1942 | Bjornson | 66/170 |
| 2,301,410 A | * | 11/1942 | Kaplan et al. | 434/95 |

(Continued)

OTHER PUBLICATIONS

Knitting Book copyright 1970 US and Canada Gottlieb Bros. N.Y. 10009.

(Continued)

*Primary Examiner*—Danny Worrell
(74) *Attorney, Agent, or Firm*—Sandra M. Kotin

(57) ABSTRACT

Disclosed herein is an afghan incorporating personalized or commemorative indicia and a method for constructing the afghan. The individual pieces of the afghan incorporate the characters and symbols of the indicia at the point of fabrication so that the afghan is complete when the pieces are joined together. The method involves determining the event to be commemorated, choosing the specific indicia to be incorporated into the afghan and anticipating the use for the completed afghan. The size of the afghan and of the individual pieces are determined as well as the number of pieces to be fabricated. A grid is constructed representing the number and arrangement of the pieces so that the characters and symbols making up the indicia may be suitably positioned within the grid and within the completed afghan to provide the most esthetic result. The craft method is then chosen as well as the type and colors of the yarn and the implement or implements needed in the fabrication. A test piece is fabricated and the quantity of yarn of each color is determined. The individual pieces are fabricated, properly arranged according to the grid, and joined together.

7 Claims, 7 Drawing Sheets

U.S. PATENT DOCUMENTS

| | | | | | |
|---|---|---|---|---|---|
| 4,103,634 | A | | 8/1978 | Schachter | 112/439 |
| 4,354,443 | A | * | 10/1982 | Abrahamson | 112/440 |
| D288,268 | S | * | 2/1987 | Durham | D6/603 |
| 4,774,728 | A | | 10/1988 | Carnicella | 2/243 R |
| 4,949,415 | A | * | 8/1990 | Selga | 5/502 |
| 5,005,219 | A | | 4/1991 | Diaz | 2/244 |
| 5,282,317 | A | * | 2/1994 | Carter et al. | 33/1 B |
| 5,749,149 | A | * | 5/1998 | Claytor | 33/1 F |
| 6,116,978 | A | * | 9/2000 | Clemens | 446/85 |
| 6,203,636 | B1 | | 3/2001 | Popper et al. | 156/72 |
| 6,862,823 | B1 | * | 3/2005 | deCarteret | 38/102 |
| 6,925,724 | B1 | * | 8/2005 | Tandy | 33/563 |

OTHER PUBLICATIONS

Phildar Mailles Editeur R.C. Roubaix 475.483.319 Boîte Postde 619-59601 Roubaix Cedexl.
Impriméen France.
Bernat Handcrafter No. 132 copyright 1966 Emile Bernat & Sons Co. Uxbridge MA 01569 USA.
Encyclopedia of Crochet Donna Kooler copyright 2002 Leisure Arts, Inc. 5701 Ranch Drive Little Rock Arkansas 72223-9633.

* cited by examiner

HAND CRAFTED AFGHAN INCORPORATING PERSONALIZED OR COMMEMORATIVE INDICIA AND METHOD OF FABRICATING SAME

FIELD OF THE INVENTION

The instant invention relates to an afghan and a method of fabricating an afghan that incorporates personalized or commemorative indicia at the point of fabrication.

BACKGROUND OF THE INVENTION

Handcrafts have been known since the dawn of time. The various needlework techniques of embroidering, crocheting and knitting are centuries old and were elevated to an art form in colonial America. Commemorative pieces were often prepared for birthdays, anniversaries and other special occasions, and were usually made from a piece of plain cloth which was embellished with embroidery. Simple designs and initials or a single name could be incorporated into a knitted or crocheted article, but more extensive indicia were often too complicated for the average craftsperson to execute and had to be added by embroidery after the article was completed. Embroidery techniques are still used when complex design elements are added to knitted and crocheted articles and also to decorate and personalize knitted and crocheted articles.

The technique known as filet crochet can be used to create personalized articles. This method involves a graphed design that is worked in combinations of solids and spaces and generally utilizes a fine thread so that the finished product resembles lace. Any design that can be graphed in black and white squares can be made by this method but it is usually used to fabricate place mats, doilies and other relatively small delicate articles that are made in one single piece. The technique of filet crochet is not practical for constructing a large and more substantial article such as an afghan.

A review of patented art in the needlework crafts reveals that few patents have issued. The ubiquitous nature of this art may offer one explanation. A patent for a method of constructing an afghan was issued to Abrahamson in 1982. (U.S. Pat. No. 4,354,443) The afghan was made of a number of individual crocheted squares. The corner and peripheral squares of the afghan were made with a decorative border added to specific outer edges of these squares. When the squares were joined together the finished afghan had a decorative border around the entire periphery and no further border had to be added. This method offered no way to add personalized indicia or other forms of decoration Though afghans are popular items for the needle worker to prepare, there have been no other innovations in this area. Webster's dictionary defines an afghan as "a blanket or shawl of colored wool knitted or crocheted in strips or squares". In colonial times afghans were often made from lengths of yarn left over from other projects and therefore such afghans incorporated a variety of colors and different textures of yarn. More recently, afghans have become important hand crafted articles in their own right. Afghans can be made in a variety, of sizes, from those for use in baby carriages or cribs to afghans that can be used as lap robes for wheelchair occupants, decorative and useful sofa throws and bed spreads for king sized beds. Afghans may also be used as wall hangings, focal points and as other decorative objects. In addition to the squares and strips, afghans may be formed from circles, hexagons, octagons, triangles or any other shapes that can be needle crafted. Each individual piece of the afghan is made separately and later all are joined together to make the whole. The individual pieces can vary from very small, requiring hundreds of pieces for a single afghan, to large where there may be only four, nine or twelve pieces in the finished product. An afghan made from long strips can have even fewer individual strips. After the pieces are joined together, a border may be added around the perimeter of the afghan. Decorative or personalized indicia are often added using various embroidery techniques. A fringe or tassels may also be added to complete the afghan.

The technique of adding indicia by embroidering the indicia on a knitted or crocheted article has been used for many years and is still taught in craft books. One example can be seen in the knitting book copyrighted in 1970 in the United States and Canada to Gottlieb Bros., New York where a number of designs can be added to knitted mittens using duplicate stitch or cross stitch. Other examples are found in the book published by Studio Graphique Phildar in 1985. Additional stitches that can be used to add designs or letters to a knitted article are illustrated and described in detail. Many other craft publications also describe or discuss these techniques.

Embroidering indicia onto a finished article, especially an afghan, has been the method of choice when the article is made using the technique of Tunisian crochet, also known as the afghan stitch. This needlework technique is a cross between crocheting and knitting that requires a special implement resembling a knitting needle with a hook at one end. Crochet stitches are formed and retained on the long needle portion. The forward row of stitches is picked up like knitting and the return row is worked off with a crocheted slip stitch. When the article is finished the indicia or design is added by embroidering over the existing stitches.

This method can be seen in the book published in 1966 by Emile Bernat & Sons, Co. of Uxbridge, Mass., and in the Encyclopedia of Crochet by Donna Kooler copyright 2002 by Leisure Arts, Inc. of Little Rock, Ark.

U.S. Pat. No. 1,197,551 to Schmidt discloses a knitted garment having ornamentation (a letter, number or symbol) added to the finished garment. This is accomplished by adding stitching of the same thread weight as the garment to form the desired ornamentation. Each stitch is applied directly over a stitch of the garment creating the appearance that the added stitch has been knitted into the garment. This requires extra steps and extra work so that completing the knitting of the garment does not produce the finished article.

Indicia can also be added to articles in the, form of chenille crests which are bonded or sewn to a completed article. Such chenille crests can be manufactured as taught by Schachter in U.S. Pat. No. 4,103,634 and by Carnicella in U.S. Pat. No. 4,774,728. A method combining the use of a chenille border and an image printed directly on a fabric is taught by Diaz in U.S. Pat. No. 5,005,219. A method of applying a graphic design to a substrate by means of ultrasonic bonding, adhesive, stapling or plastic fasteners is taught by Popper et al. in U.S. Pat. No. 6,203,636. None of these methods would be practical for adding indicia to a hand crafted afghan.

Published instructions for fabricating afghans are specific and complete for a particular afghan. They do not include variations that may assist the person using those instructions to make a gift which incorporates personalized or commemorative indicia that has not been included in those instructions.

There is a need for a method of preparing an afghan that incorporates personalized or commemorative indicia into the substrate of the afghan as the individual pieces of the afghan are being fabricated. This insures that once all of the pieces are completed and fastened together the afghan with its incorporated indicia is complete.

BRIEF SUMMARY OF THE INVENTION

The present invention provides an afghan and a method for fabricating an afghan that incorporates personalized or commemorative indicia into the individual pieces that make up the afghan, as those pieces are being fabricated.

An object of the present invention is to provide an efficient method of incorporating indicia into an afghan during the fabrication of the individual pieces.

It is another object of the present invention to provide a method of making an afghan containing personalized or commemorative indicia selected and designed by the fabricator.

Another object of the present invention is to provide a method of incorporating specific indicia within the individual pieces of an afghan so that when the pieces are joined together the afghan is complete.

A further object of the present invention is to provide a method of making an afghan incorporating specific indicia within the individual pieces of the afghan so as to reduce the number of steps needed in completing the finished product.

A still further object of the present invention is to provide a method of constructing an afghan that requires no techniques other than the knitting or crocheting skills used to make the individual pieces.

An object of the present invention is to provide a method of fabricating an afghan that incorporates all of the steps needed from conception to completion.

A further object of the present invention is to provide a method of blocking out an array of the pieces of the afghan in the form of a grid and inserting the commemorative or personalized indicia into the grid for use as a guide when fabricating the pieces and connecting them together.

Another object of the present invention is to provide an afghan that has personalized or commemorative indicia incorporated within the fabric of the afghan at the point of fabrication:

The present invention is a method of fabricating an afghan incorporating personalized or commemorative indicia at the point of fabrication and being of a type composed of a plurality of individual pieces that are fabricated separately and then joined together to form a cohesive whole. The method comprises the steps of selecting a person or event which the afghan will commemorate; selecting the specific indicia to form a message of the afghan; choosing characters that make up the specific indicia so as to express the message to be incorporated into the afghan; anticipating the use for the completed afghan; determining the size of the completed afghan; selecting the size of the individual pieces of the afghan; choosing the shape of the individual pieces of the afghan; using the size of the completed afghan and the size of the individual pieces to calculate the number of individual pieces that will make up the completed afghan; determining an arrangement of the individual pieces of the afghan with regard to the number of pieces in the horizontal direction and the number of pieces in the vertical direction; formulating a first grid pattern wherein each unit of the first grid pattern represents one individual piece of the afghan and setting forth the same number of units in the horizontal direction and in the vertical direction so as to conform to the arrangement of the individual pieces in the completed afghan; placing the chosen characters into the first grid pattern to represent an arrangement of the characters in the completed afghan; selecting a method of fabrication of the afghan; choosing specific stitches to be used to fabricate the afghan; selecting a type of yarn to be used; determining the size of fabricating implement needed; selecting colors of the yarn to be used with consideration given to overall appearance, purpose, event commemorated, personal taste of the recipient, and contrast of the indicia; determining the quantity of yarn of each color that will be required; obtaining the necessary quantity of yarn and the fabricating implement needed; obtaining a second grid pattern setting forth the positioning of each of the characters within one of the individual pieces of the afghan for use as a guide in fabricating the individual pieces containing those characters; fabricating the individual pieces that will make up the completed afghan using the second grid pattern for the incorporation of the chosen characters and using the first grid pattern to determine the number and nature of each of the individual pieces fabricated; arranging the completed individual pieces according to the first grid pattern; and connecting the individual pieces together as indicated in the first grid pattern to form the completed afghan. The completed afghan contains the selected commemorative or personalized indicia.

An afghan containing personalized or commemorative indicia comprises a plurality of individually fabricated pieces of like shape and size, a first portion of the pieces each containing at least one character incorporated therewithin at the point of fabrication, the first portion of pieces when arranged within the completed afghan forming specific personalized or commemorative indicia, and a second portion of the pieces being blank as to characters; means for arranging the pieces in side by side relation so as to best display said characters in the formation of the specific personalized or commemorative indicia within the completed afghan; and means for joining the pieces together while maintaining the arrangement. The completed afghan exhibits the personalized or commemorative indicia in a cohesive and comprehensive arrangement.

A method of fabricating an afghan incorporating personalized or commemorative indicia at the point of fabrication and being of a type composed of individual pieces that are fabricated separately and then joined together to form a cohesive whole comprises the steps of: selecting a person or event which the afghan will commemorate; selecting the specific indicia to form the message of the afghan; choosing characters that make up the specific indicia so as to express the message to be incorporated into the afghan; anticipating the use for the completed afghan; selecting the size of the completed afghan; obtaining a set of instructions for the fabrication of an afghan of the selected size, composed of a plurality of individual pieces, and setting forth a method of construction, type and quantity of yarn, implement needed and arrangement of the individual pieces; formulating a first grid pattern wherein each unit of the grid pattern depicts one individual piece of the afghan, said grid pattern representing the number of units in the horizontal direction and in the vertical direction as set forth in the instructions and conforming to the arrangement of the individual pieces in the completed afghan; placing the chosen characters into the first grid pattern to constitute an arrangement of the characters in the completed afghan such that the individual pieces containing the characters constitute a first portion of pieces and the remaining individual pieces constitute a second portion of pieces; selecting the colors of the yarn to be used with consideration given to overall appearance, purpose, event commemorated, personal taste of the recipient, and contrast of the characters making up the specific indicia; obtaining the necessary quantity of yarn and the implement as set forth in the instructions with consideration given to any additional yarn needed for the inclusion of the specific indicia; obtaining a second grid pattern containing the positioning of the characters within each of the first portion of pieces for use as a guide in fabricating the first portion of pieces; fabricating the individual pieces that will make up the completed afghan following the instructions and the first grid pattern and using the second grid pattern to incorporate the chosen characters into the first portion of pieces; arranging the completed individual pieces according to the first grid pattern; and connecting the individual pieces together as indicated in the first grid pattern to form the completed afghan. The completed afghan contains the desired commemorative or personalized indicia.

A method of incorporating personalized or commemorative indicia into an afghan of a type composed of a plurality of individual pieces that are fabricated separately and then joined together to form a cohesive whole, the indicia being incorporated at the point of fabrication of the individual pieces comprises the steps of: selecting a person or event which the afghan will commemorate; selecting the specific indicia to form a message of the afghan; choosing characters that make up the specific indicia so as to express the message; determining a number of the individual pieces of the afghan; determining an arrangement of the individual pieces in the afghan with regard to the number of pieces in the horizontal direction and the number of pieces in the vertical direction; formulating a first grid pattern wherein each unit of the grid pattern represents one individual piece of the afghan and setting forth the same number of units in the horizontal direction and in the vertical direction so as to conform to the arrangement of the individual pieces in the afghan; placing the chosen characters into the first grid pattern to represent an arrangement of the indicia for the completed afghan; and obtaining a second grid pattern containing the positioning of each of the characters within an individual piece of the afghan for use as a guide in the fabrication of the individual pieces containing the characters. When each individual piece of the afghan is fabricated, the individual pieces are arranged according to the first grid pattern and the pieces are joined together the completed afghan contains the desired commemorative or personalized indicia.

Other features and advantages of the invention will be seen from the following description and drawings.

DETAILED DESCRIPTION OF THE INVENTION

When fabricating an afghan incorporating special indicia, the particular event or occasion to be celebrated or the person to be feted must be determined. Thereafter, the manner of expressing the specific date, names or other words, as well as figures or symbols may be selected. An afghan incorporating words such as "birthday" or "anniversary", or a full date with the month spelled out may require much more careful planning then one that uses an abbreviated form of a date and a short name or title. Therefore, once the event has been selected, the quantity of characters, the letters, numbers or symbols, needed to convey the desired message must be carefully thought out.

In addition to the occasion to be commemorated, the specific use of the completed afghan may be the next consideration. The anticipated use of the afghan may determine the finished size. Afghans commemorating the birth of a child may be dimensioned for use in a crib or carriage and may typically measure from 28 in×30 in (71 cm×76 cm) to 30 in×36 in (76 cm×91 cm). Afghans used as lap robes may measure from 50 in×60 in (127 cm×152 cm) to 50–60 in×70 in (127–152 cm×178 cm) and may often be presented as birthday or anniversary gifts. Wall hangings and bed covers may be presented for other occasions and may be sized accordingly.

Once the overall size of the afghan is determined, the size and shape of the individual pieces may be chosen. In the succeeding discussion, for illustrative purposes, the individual pieces of the afghan may be expressed as squares, though it should be understood that any other desired shapes such as circles, triangles, rectangles, hexagons or octagons, as well as long strips may be used.

An afghan may be made up of many small squares or fewer larger squares. The size of each individual square together with the overall size of the afghan may then establish the number of squares needed. The width of the afghan divided b y the width of an individual square may provide the number of squares running horizontally (across) while the length of the afghan divided by the length of an individual square may provide the number of squares running vertically (down).

An afghan that may be 30 in×36 in (76 cm×91 cm) and composed of squares that may be 6 in×6 in (15 cm×15 cm) may require the fabrication of 30 squares. A design grid may be formulated indicating the number and arrangement of the squares. For an afghan composed of 30 squares, an ideal arrangement may have 5 squares across and six squares down. Such a grid may be seen in FIG. 1. Once the grid is drawn, the characters making up the selected indicia may be placed within the squares of the grid. Often, there may be more than one arrangement of the characters, and sometimes there may be many possible arrangements. The 30 squares may also be arranged with 6 squares across and 5 squares down.

Figure 1:
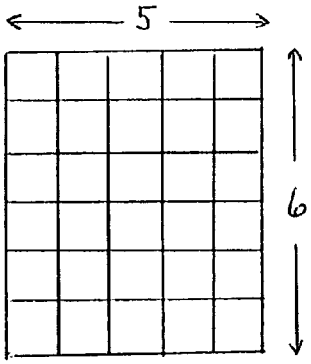
FIG. 1 is an example of a typical grid.
Figure 2A:
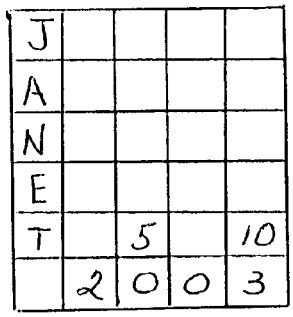
FIGS. 2A and 2B are grids showing two arrangements and variations of specific indicia.
Figure 2B:
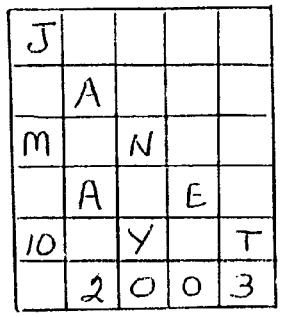
Figure 3:
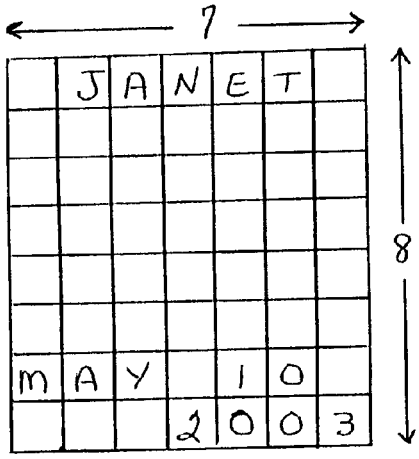
FIG. 3 is a larger grid with another arrangement of the indicia of FIG. 2B.

If the grid illustrated in FIG. 1 is to represent an afghan fabricated to commemorate the birth of a baby, the baby's name and birth date may be fitted into the 30 squares. Each square may have one character, or each may have more than one character. If baby JANET was born on May 10, 2003, two of the various possible arrangements of indicia may be seen in FIGS. 2A and 2B. If the desired indicia, or a particular arrangement of the indicia does not fit within the number of squares selected, the arrangement may be altered or the number of squares and/or the size of the squares may be altered to accommodate the indicia. Sometimes the indicia itself may have to be modified to fit within a grid. As an example, the indicia illustrated in FIGS. 2A and 2B may be placed in a 7×8 grid (56 squares) as set forth in FIG. 3. If the squares remain the same size (6 in×6 in:15 cm×15 cm), this afghan may measure 42 in×48 in (107 cm×122 cm). If it is desired that the size of the afghan remain approximately the same, 30 in×36 in (76 cm×91 cm), each of the 56 squares may be reduced to 4.5 in (11.4 cm) on a side. (For ease of illustration, the squares of all of the grids in FIGS. 1 through 10B are the same size. ) The number and/or size of the squares may be adjusted to conform to a desired end. The fabricator may wish to have a border of one or more squares that contain no indicia surrounding the commemorative indicia, or a number of fancy, patterned squares, or squares containing special design elements may be included at specific points within or around the commemorative indicia. All of these options may be placed within sample grids until the desired selection and arrangement are attained.

The placement of the indicia within the grid may be dictated by the number of characters involved, or it may be a design choice. Some design choices may be the number of characters, the nature of the characters, how the characters are to be fitted into the grid, whether the long edge will be vertical or horizontal, whether or not to incorporate symbols, whether or not there will be decorative squares, and how many symbols or decorative squares will be included.

Figure 4A:
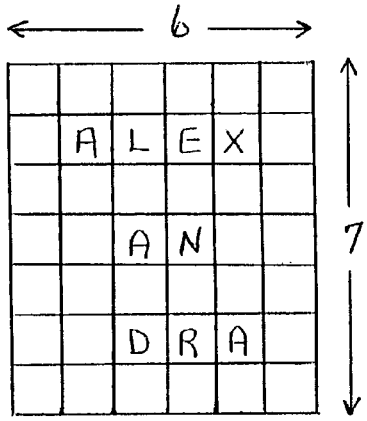
FIGS. 4A–D are grids with four different arrangements of another set of indicia.
Figure 4B:
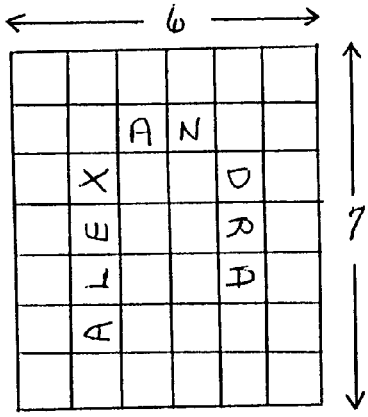
Figure 4C:
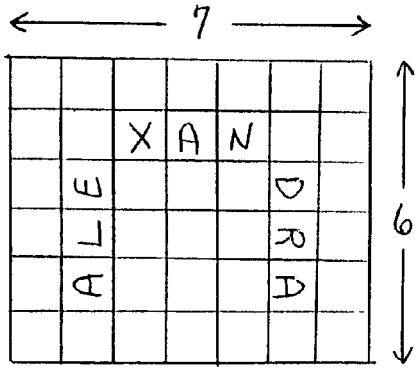
Figure 4D:
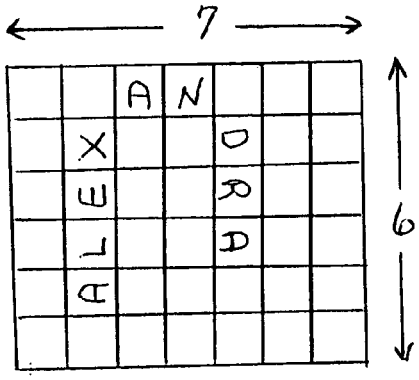
Figure 5A:
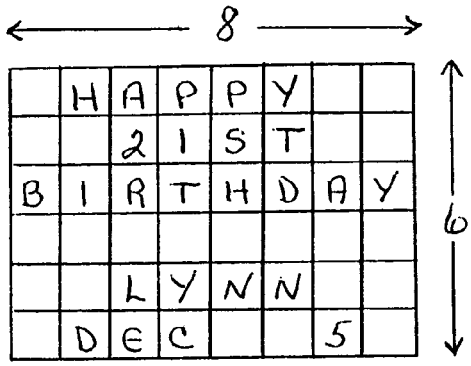
FIGS. 5A–F are grids with a further set of indicia.
Figure 5B:
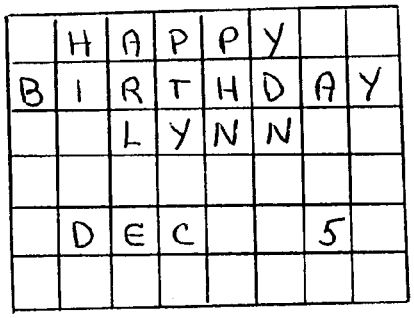
Figure 5C:
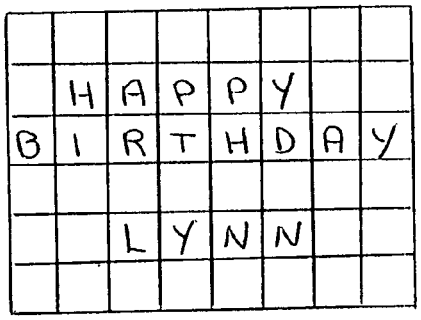
Figure 5D:
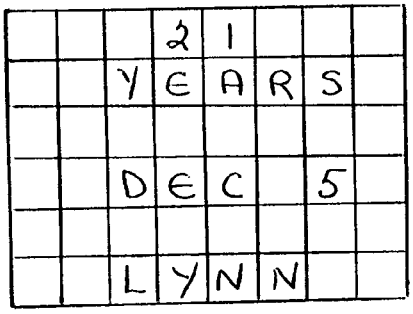
Figure 5E:
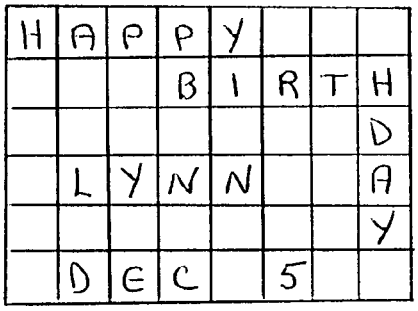
Figure 5F:
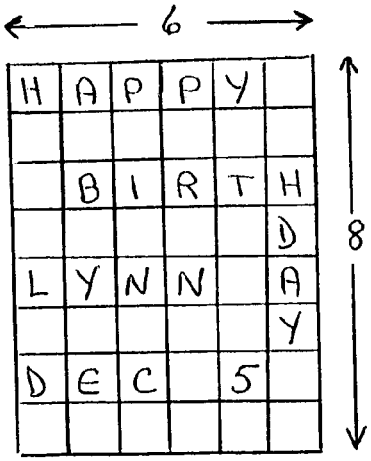

There may be one, a few, or many possible arrangements for the same set of indicia. As one example, an afghan may incorporate only the name of the recipient such as "Alexandra". Using a grid of 42 squares this name may be placed in a variety of arrangements. FIG. 4A may have 6 squares across and 7 squares down and may show all letters reading from left to right. The letters may be divided into three of the seven horizontal rows so that there may be no letters in the peripheral squares and no successive horizontal rows with letters. FIG. 4B, also in the 6×7 arrangement, may show the same letters arranged in an inverted U-shape, and FIG. 4C may show the inverted U-shape, but here the grid may run in the alternate direction with the rows across having seven squares and the rows down having six squares. This latter arrangement may be the most symmetrical for this indicia in a U-shaped arrangement. The letters in a 7×6 arrangement may also be set forth as shown in FIG. 4D which is an off-centered unsymmetrical arrangement.

Indicia commemorating a birthday may be seen in FIGS. 5A through 5F. All of these arrangements may be seen on grids having 48 squares, 8 squares in one direction and 6 squares in the other. FIGS. 5A through 5E may be illustrative of 8×6 grids while FIG. 5F may have a 6×8 arrangement.

Figure 6:
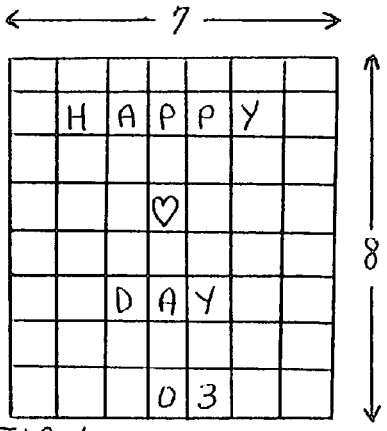
FIG. 6 is a grid containing indicia and also incorporating a symbol.
Figure 8A:
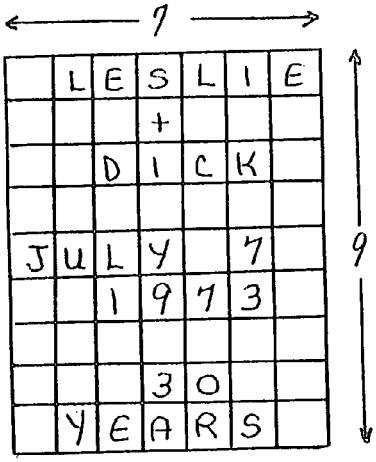
FIGS. 8A–C are grids with other arrangements and styles of indicia.
Figure 8B:
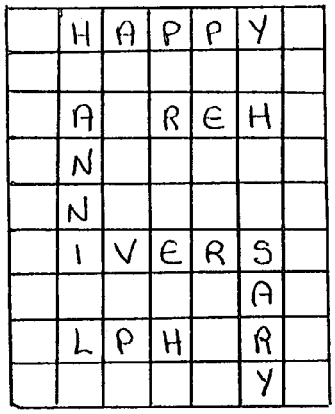
Figure 9:
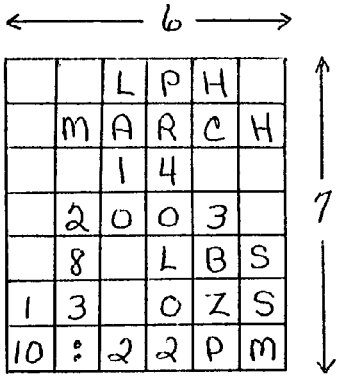
FIG. 9 is a grid with a large number of characters.
Figure 10A:
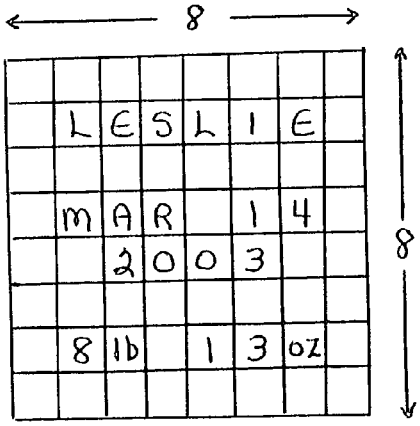
FIGS. 10A–B are grids with more than one character in a square.
Figure 8C:
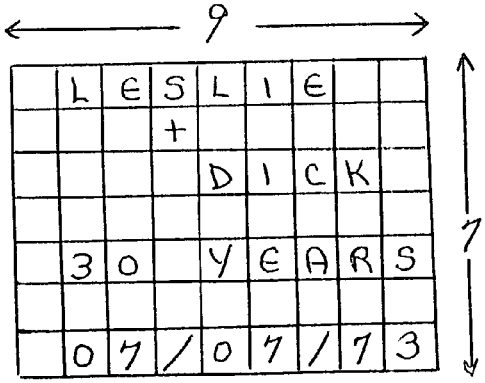
Figure 10B:
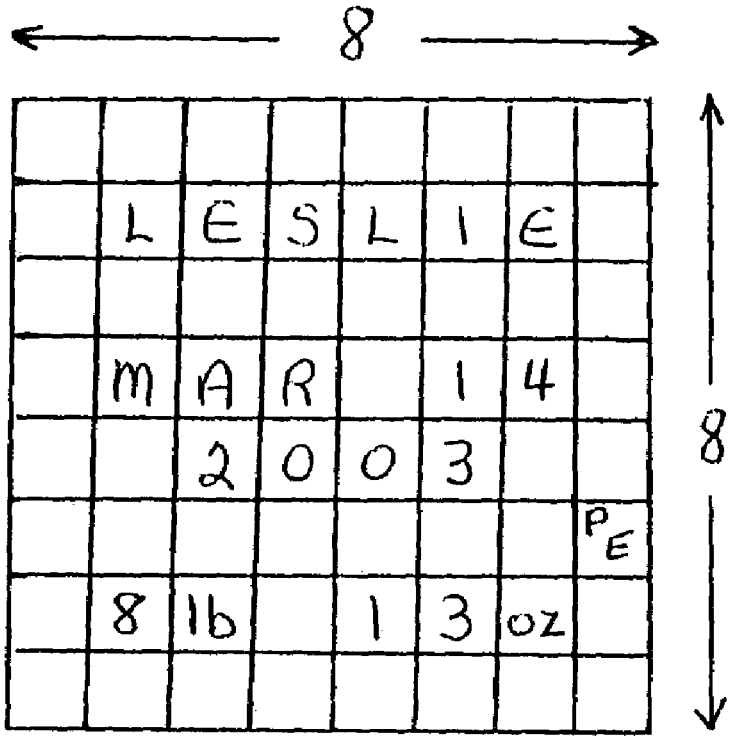
Figure 11:
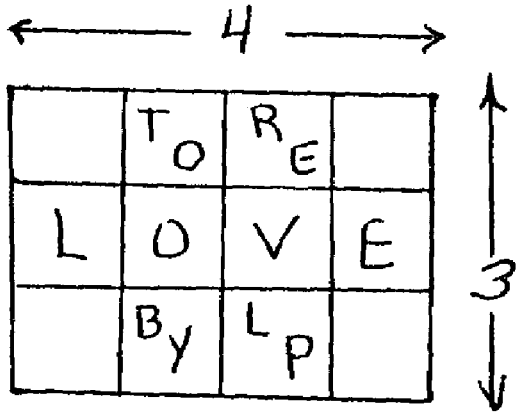
FIGS. 11 is a grid with fewer, but larger squares, with more than one character in several squares.

The fabricator may adopt any type of character, symbol or combination to best express the occasion or person the afghan is to commemorate. FIG. 6 may show a 7×8 grid representing a Valentine's Day gift. The indicia may be centered and the well known heart symbol may be included. FIGS. 7 and 8A through 8C may be examples of grids having 7 squares in one direction and 9 squares in the other. FIG. 8A may use the symbol "+" for the word "and" and FIG. 8C may use the slash "/" to separate parts of the date. FIG. 9 may use a 6×7 grid to celebrate the birth of a baby with each square having one character. FIG. 10A may commemorate the same birth using an 8×8 grid which may have two characters in one square, i.e. , "lb" and "oz". This use of two characters within one square may help to convey the intended message while not taking away from the main message. Having two characters in one square may also permit additional indicia to be included without the necessity of increasing the number of squares in the completed afghan. The example seen in FIG. 11 may represent an afghan having only twelve larger squares that may easily incorporate more than one character in a square. The use of two characters in one square may also be used under certain circumstances to allow a word to stand out.

The first and last initials of the fabricator may also be included as additional indicia. These may be placed in two squares, or the initials may be smaller letters placed in a single square as may be seen in FIG. 10B. Such notation by the fabricator may be added to any of the above-noted examples. The inclusion of the fabricator's initials, while not a focal point of the message, may insure that future generations may know the creator of the gift.

Figure 7:
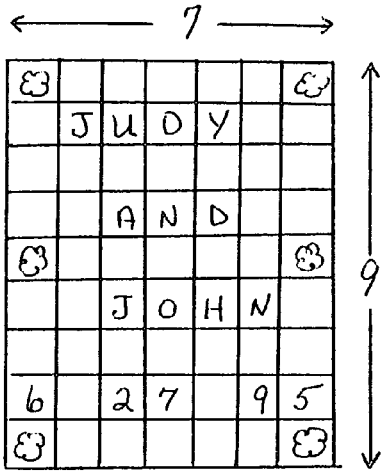
FIG. 7 is a grid containing indicia and also incorporating a decorative design.

In addition to the necessary indicia for the event being celebrated or the person being honored, some of the squares may be purely decorative as may be seen in FIG. 7. This, example may be a symmetrically arranged afghan with a flower pattern placed in six of the peripheral squares. As may be noted from the above examples, many of the squares in a particular afghan may contain indicia, or only a few of the squares. These determinations may also be design choices of the fabricator.

Once the particular indicia and their arrangement are finalized, the method of fabrication may be determined. As previously noted, afghans may be knitted, crocheted or made by Tunisian crochet (afghan stitch). Each of these needlework methods may provide a wide variety of stitches, and each may produce a somewhat different effect. The method chosen may be made with a specific stitch pattern in mind, or the selection of the stitch pattern may be made after the needlework method is chosen. These determinations may also depend upon the degree of skill of the fabricator.

The next step in fabricating a commemorative afghan may be the selection of the yarn to be used. Again, there may be many choices such as wool, acrylic, mohair, cotton, and blends composed of more than one fiber. The thickness and specific type of yarn may also be selected as well as the size of the implement, needles or hook, needed for the fabrication. The size of the implement may depend on qualities of the yarn, such as thickness and texture, and how tight or loose the fabricator works. The qualities of the yarn and the size of the implement also may determine the number of stitches and rows needed to make up a square of a certain size. The thicker and the more highly textured the yarn may be, the less stitches may be in a row and the less rows in the square. This consideration may also bear on the time needed to construct the afghan. The fewer stitches and rows, the less time needed to construct each square and the less time to complete the finished afghan.

With the event being commemorated, the anticipated use for the afghan, the overall appearance of the finished product, and the tastes of the recipient in mind, the color or colors of the yarn for the background and the indicia may be selected. Since indicia are to be incorporated into the afghan at the point of fabrication, it may be important to have colors that blend well while offering sufficient contrast to permit the message to stand out. Some afghans may have light background color or colors and dark indicia, while others may have a dark background with light indicia. The contrast may also be obtained using complementary or contrasting colors of similar intensity. Other options involving color may be the number of background colors and the number of colors used in the squares that do not contain characters or other design elements. There may also be more than one color used for the indicia either for color harmony or emphasis of particular characters.

Before beginning the afghan and even before purchasing the yarn, it may be best to fabricate a test square using the selected implement and yarn of the selected thickness, texture and composition. Once it is determined how much yarn is needed for the test square, the quantity of yarn for the completed afghan may be determined.

The quantity of yarn needed may depend upon the size of the afghan, number of squares of each color, extent of indicia and any other decorative design to be incorporated, type and thickness of yarn, needle or hook size, number of colors being used and how much of each color may be incorporated. Colors used solely for the indicia may require one or two balls of yarn while colors used for the background squares may require many balls of yarn. Yarn packages usually indicate the number of feet or yards of yarn in the ball or skein. Some extra yarn may be purchased to insure enough yarn in a particular dye lot to complete the project.

Figure 12A:
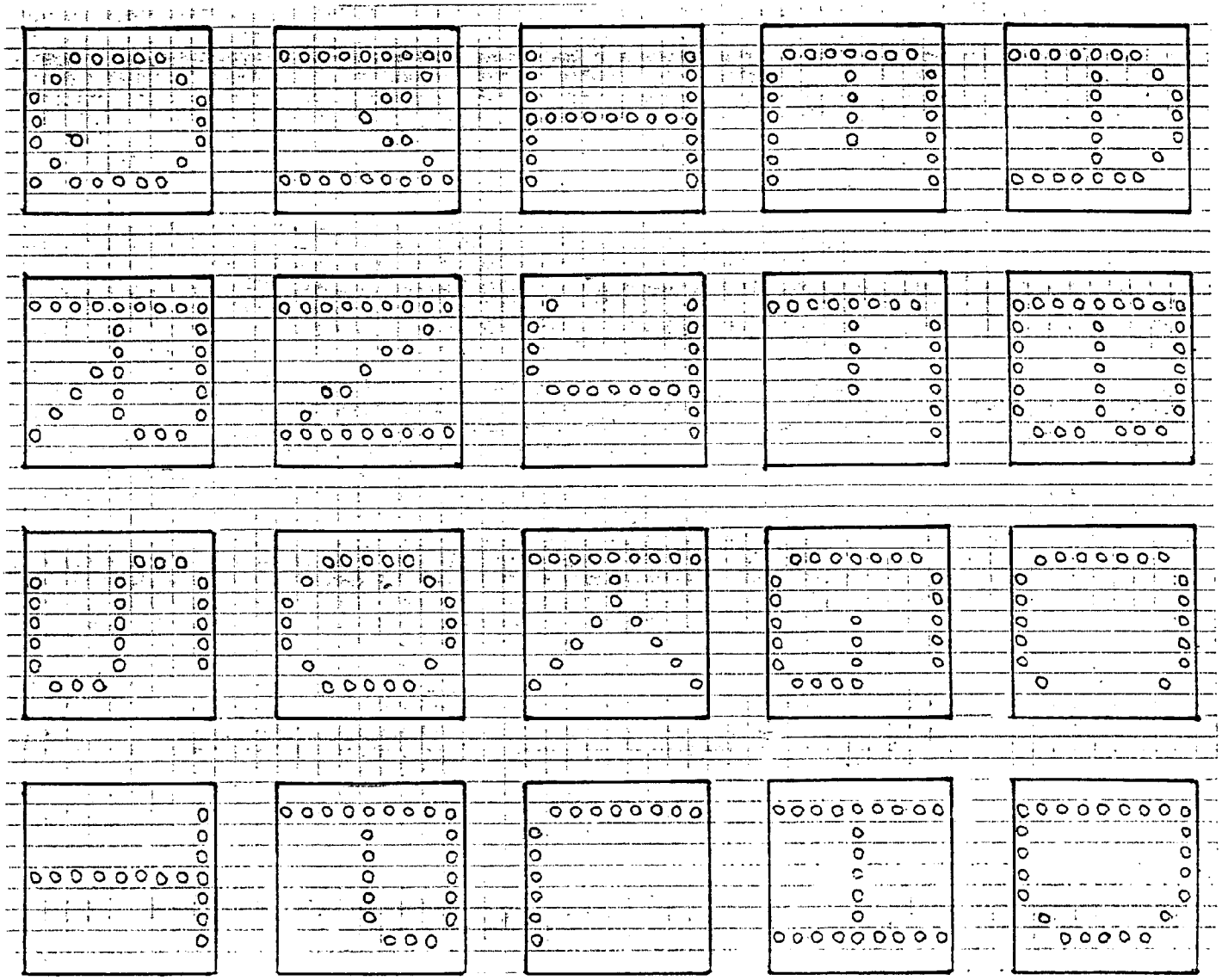
FIGS. 12A–C are grids expressing stitch arrangements for inserting characters into individual squares.
Figure 12B:
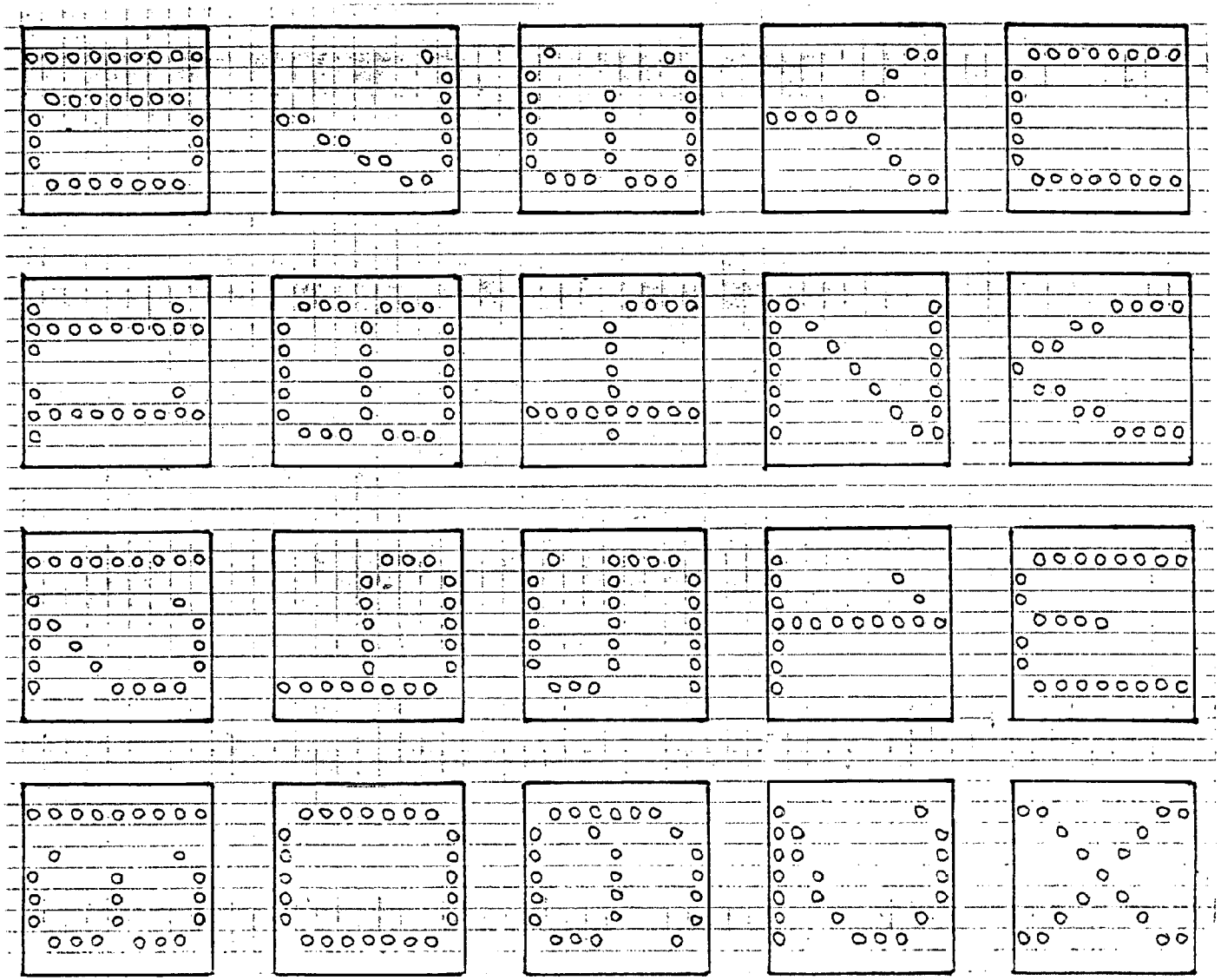
Figure 12C:
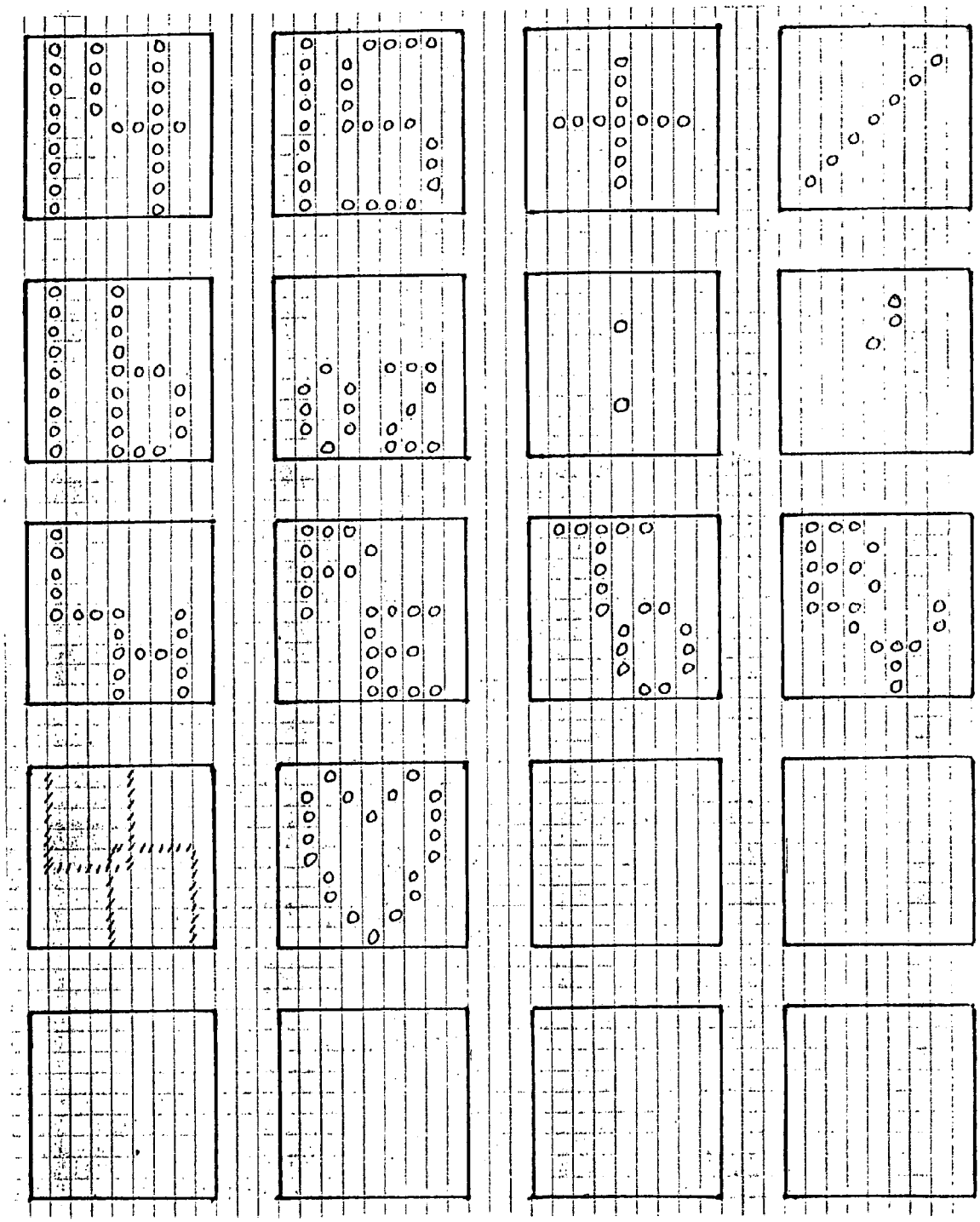
Figure 1:
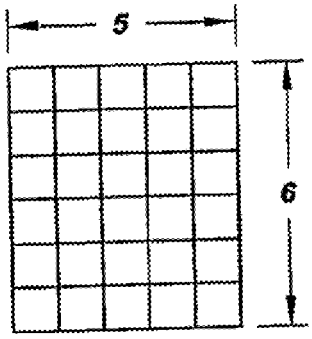
Figure 2A:
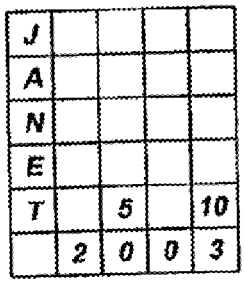
Figure 2B:
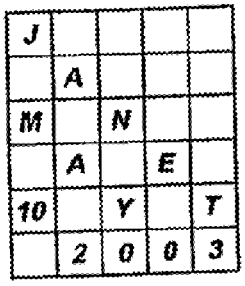
Figure 3:
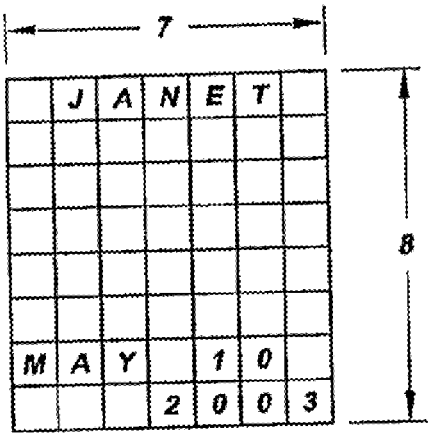
Figure 4A:
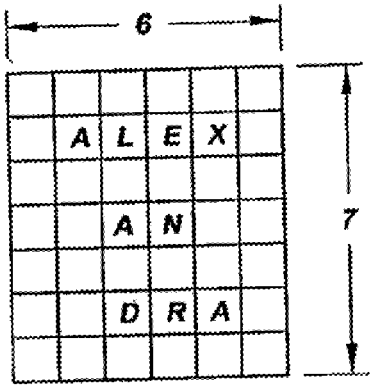
Figure 4B:
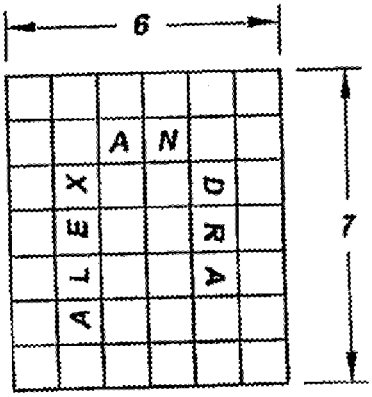
Figure 4C:
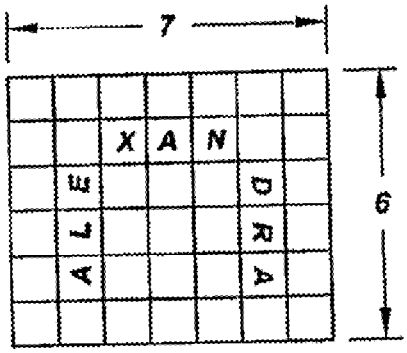
Figure 4D:
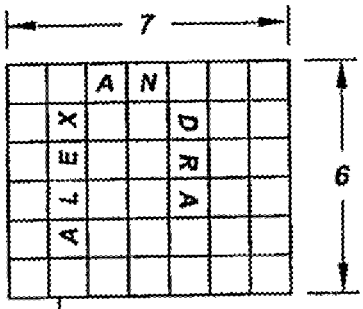
Figure 5A:
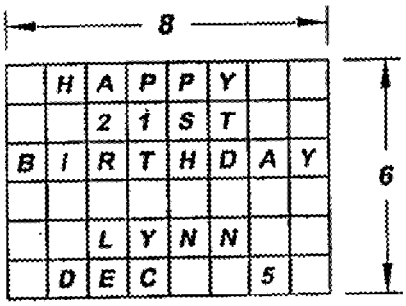
Figure 5B:
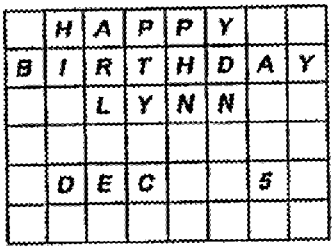
Figure 5C:
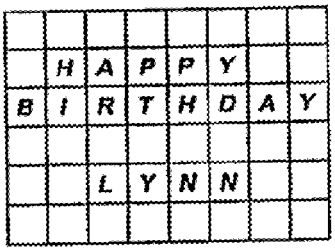
Figure 5D:
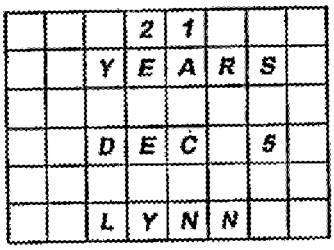
Figure 5E:
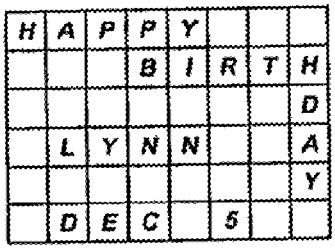
Figure 5F:
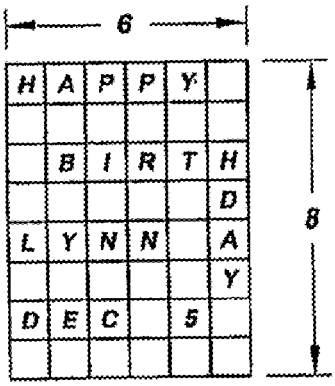
Figure 6:
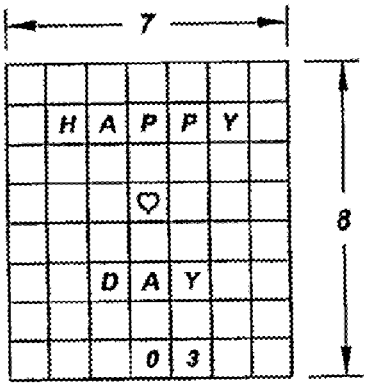
Figure 7:
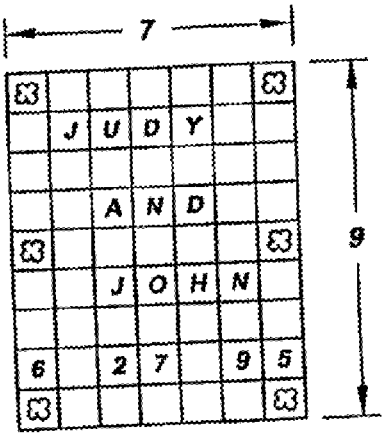
Figure 8A:
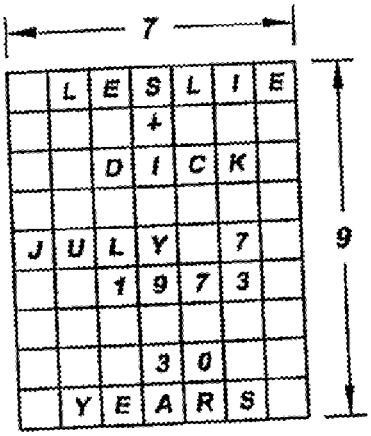
Figure 8B:
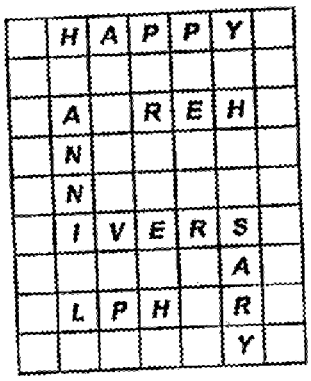
Figure 8C:
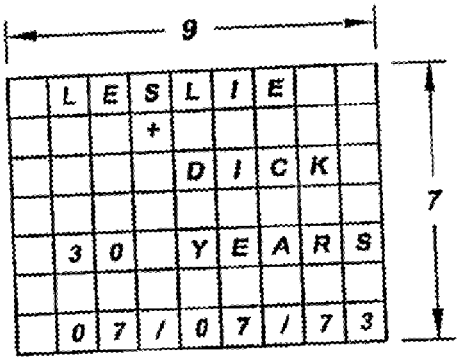
Figure 9:
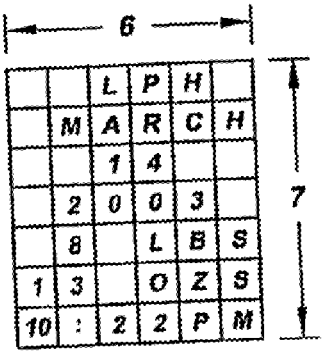
Figure 10A:
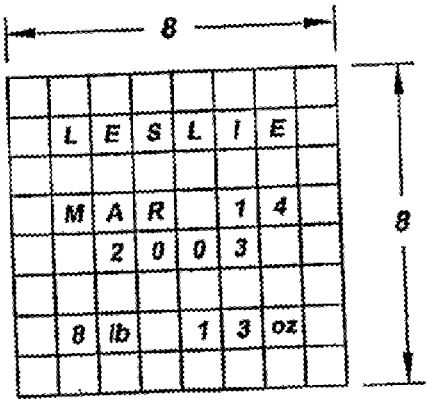
Figure 10B:
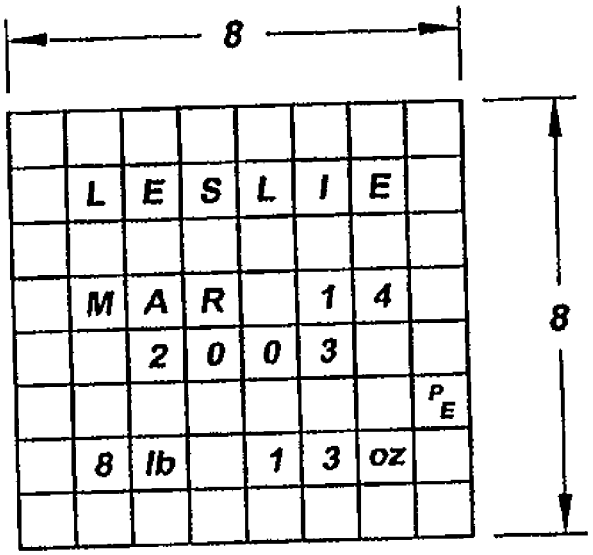
Figure 11:
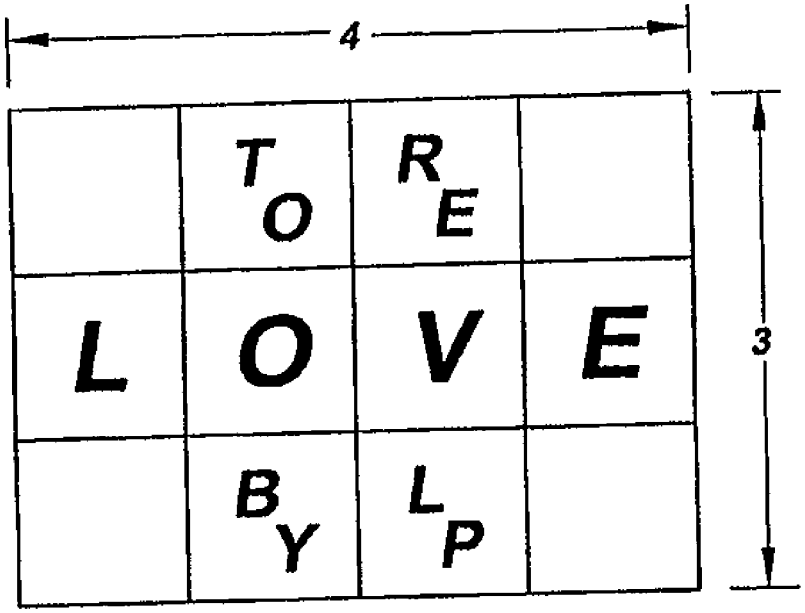
Figure 12A:
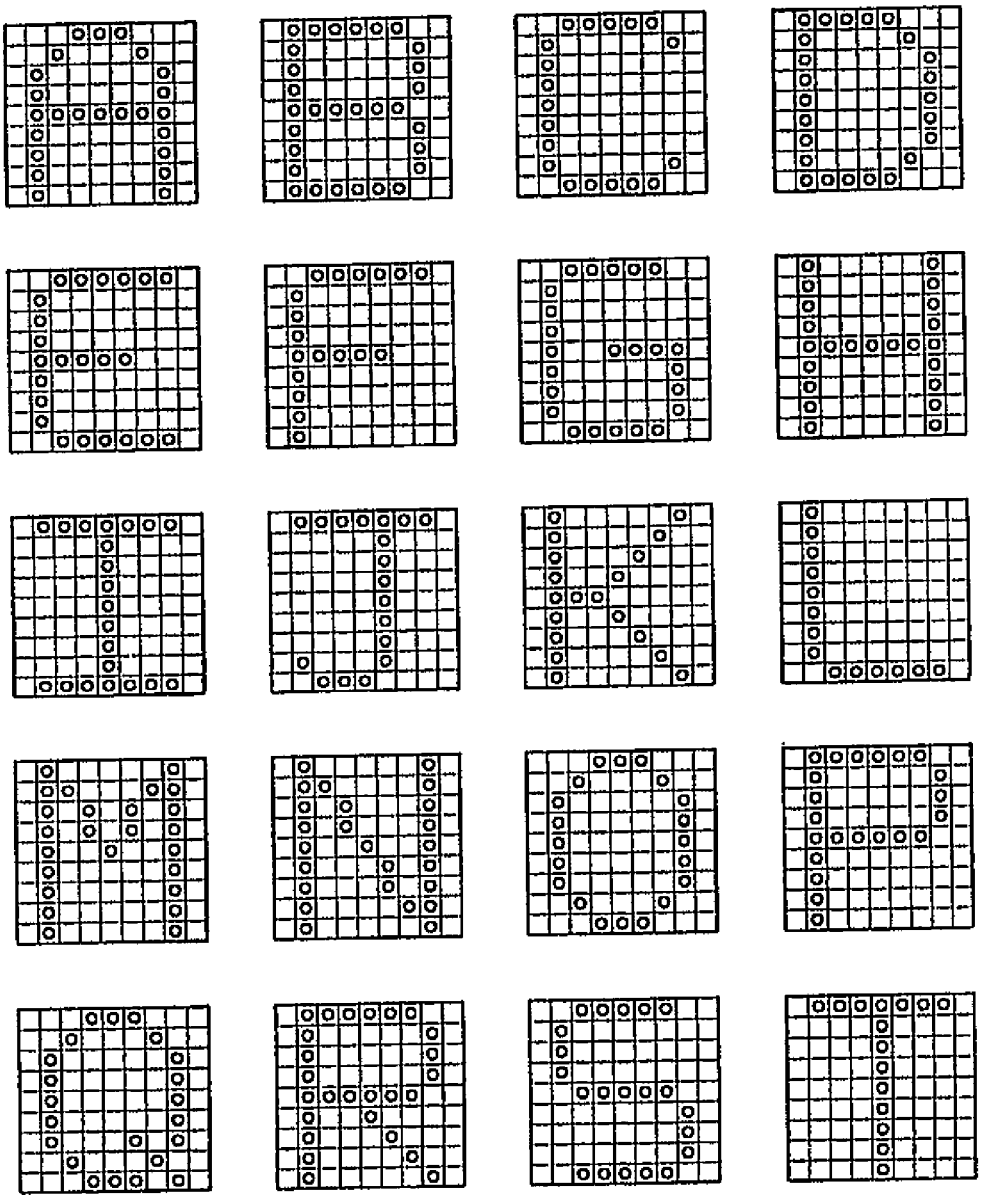
Figure 12B:
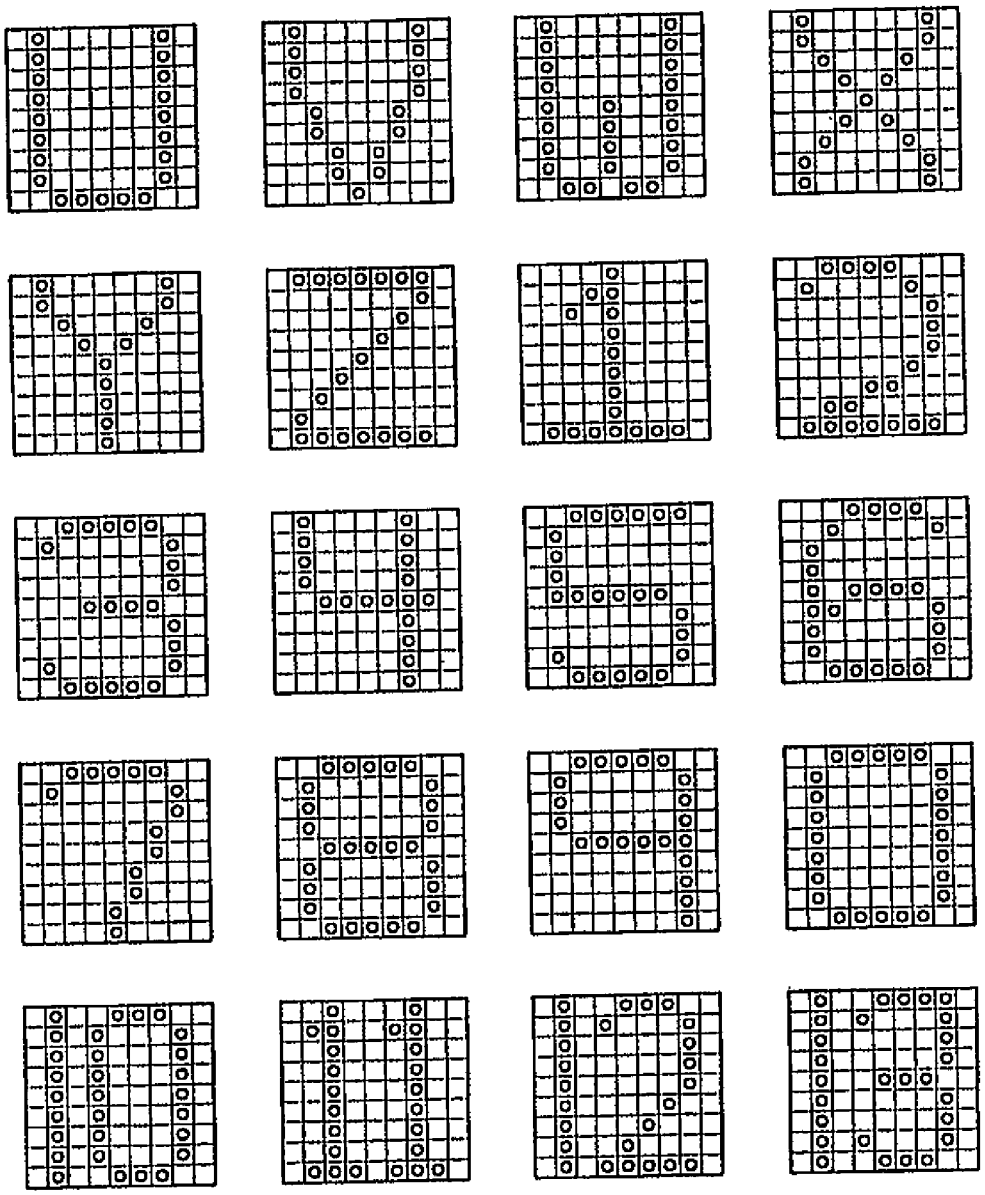
Figure 12C:
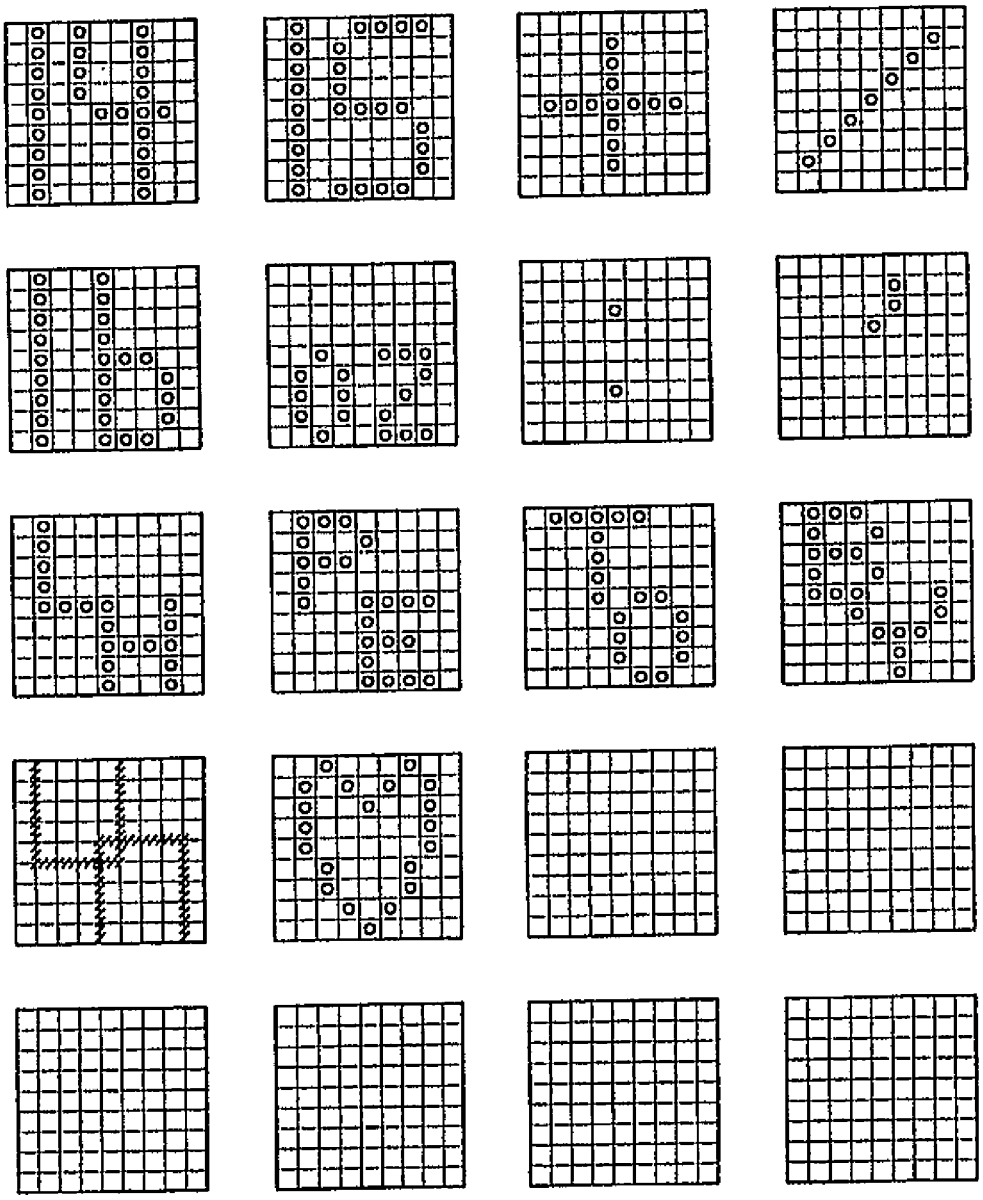
Figure 1:
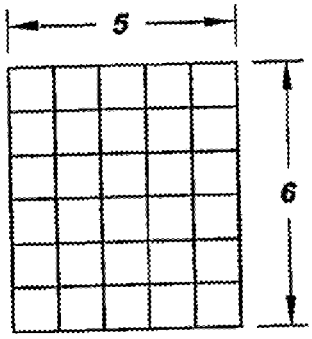
Figure 2A:
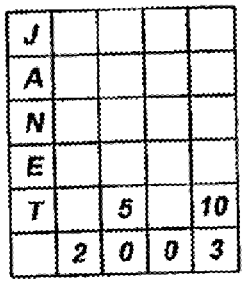
Figure 2B:
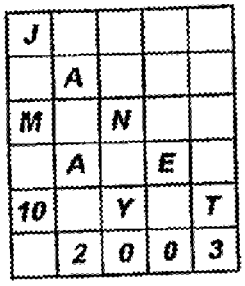
Figure 3:
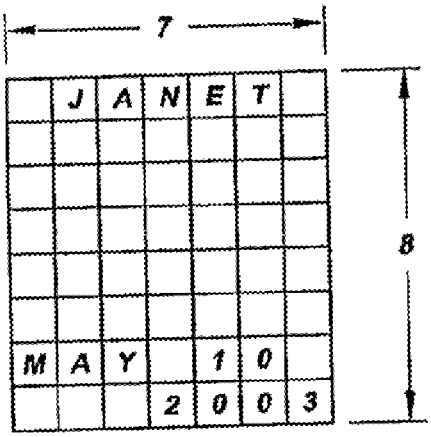
Figure 4A:
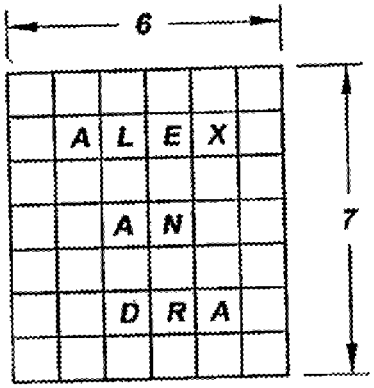
Figure 4B:
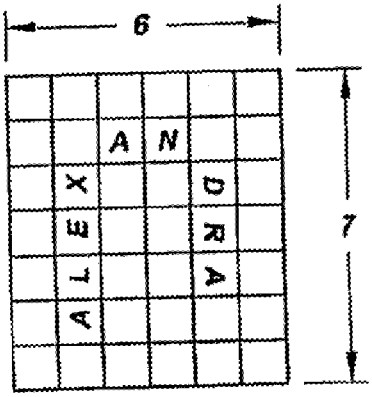
Figure 4C:
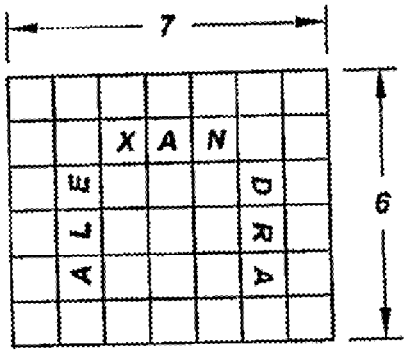
Figure 4D:
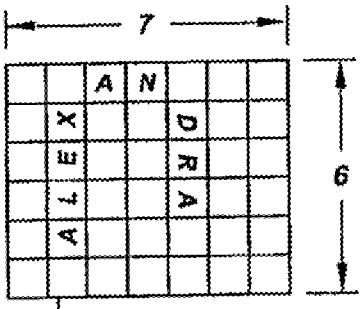
Figure 5A:
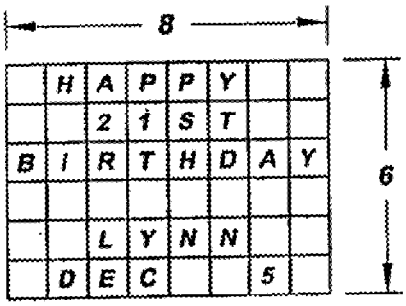
Figure 5B:
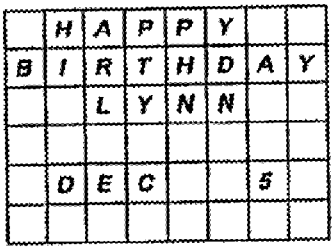
Figure 5C:
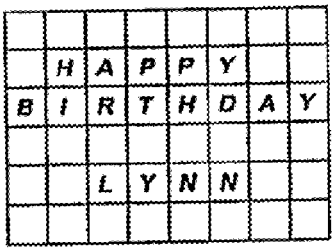
Figure 5D:
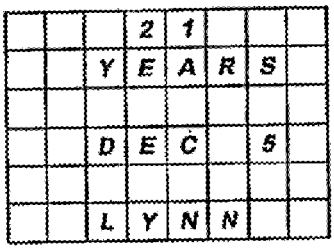
Figure 5E:
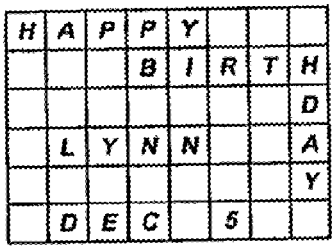
Figure 5F:
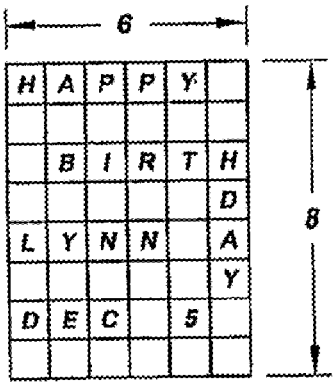
Figure 6:
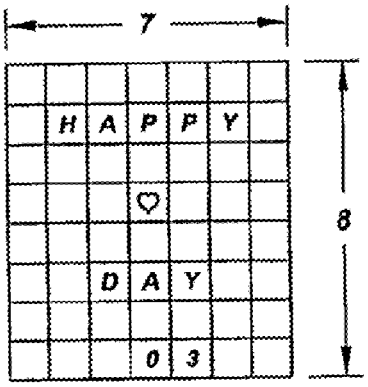
Figure 7:
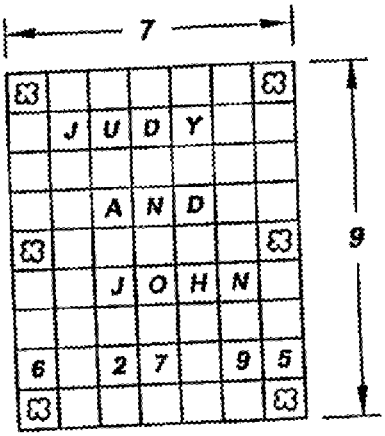
Figure 8A:
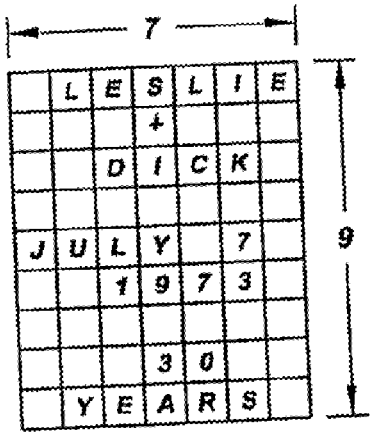
Figure 8B:
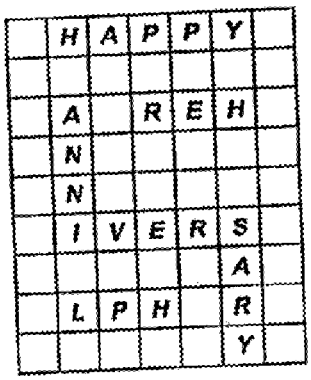
Figure 8C:
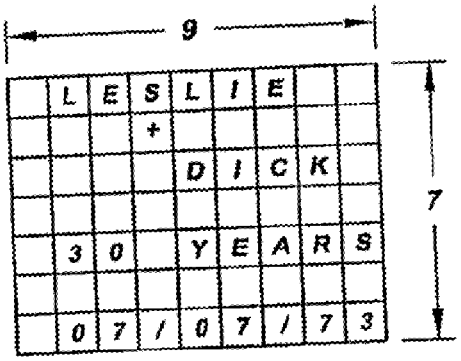
Figure 9:
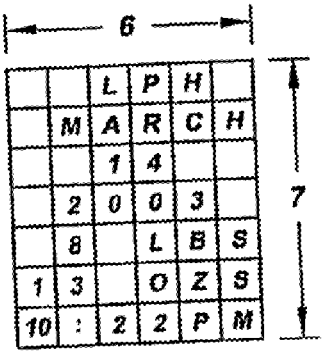
Figure 10A:
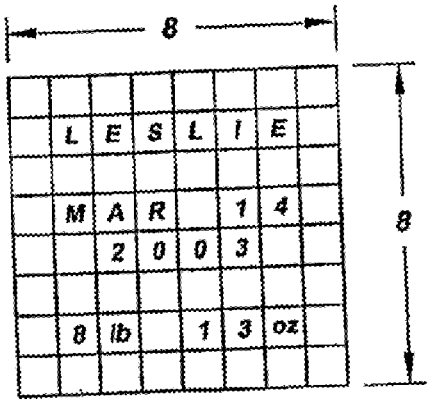
Figure 10B:
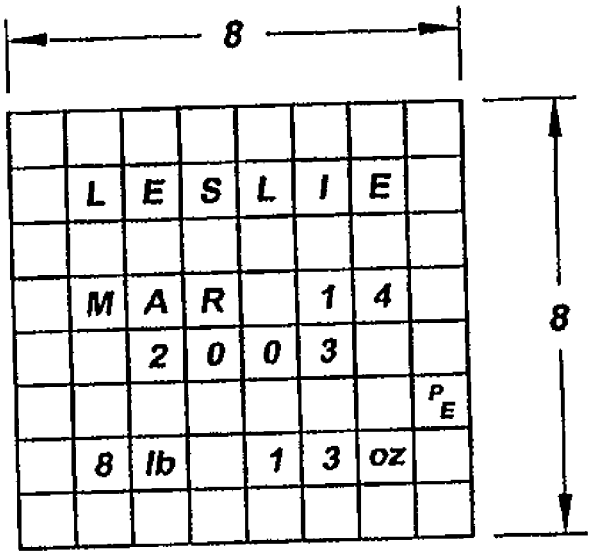
Figure 11:
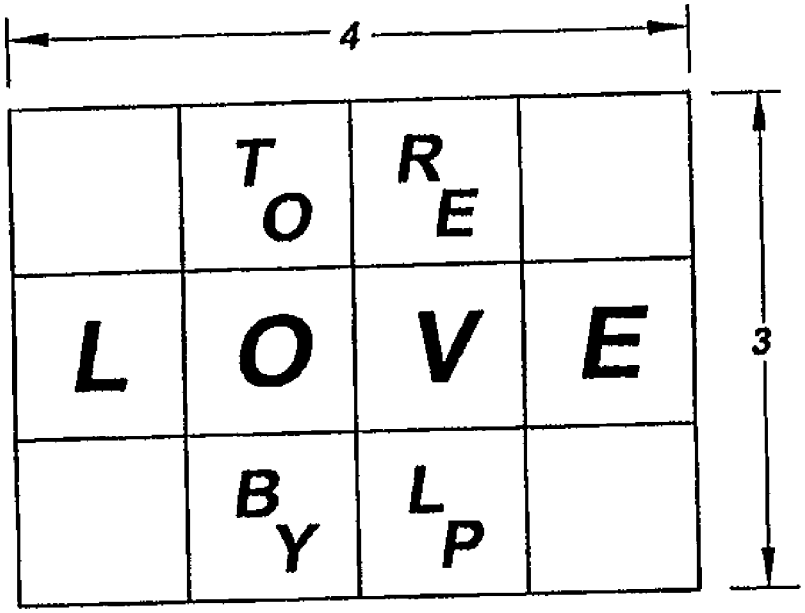
Figure 12A:
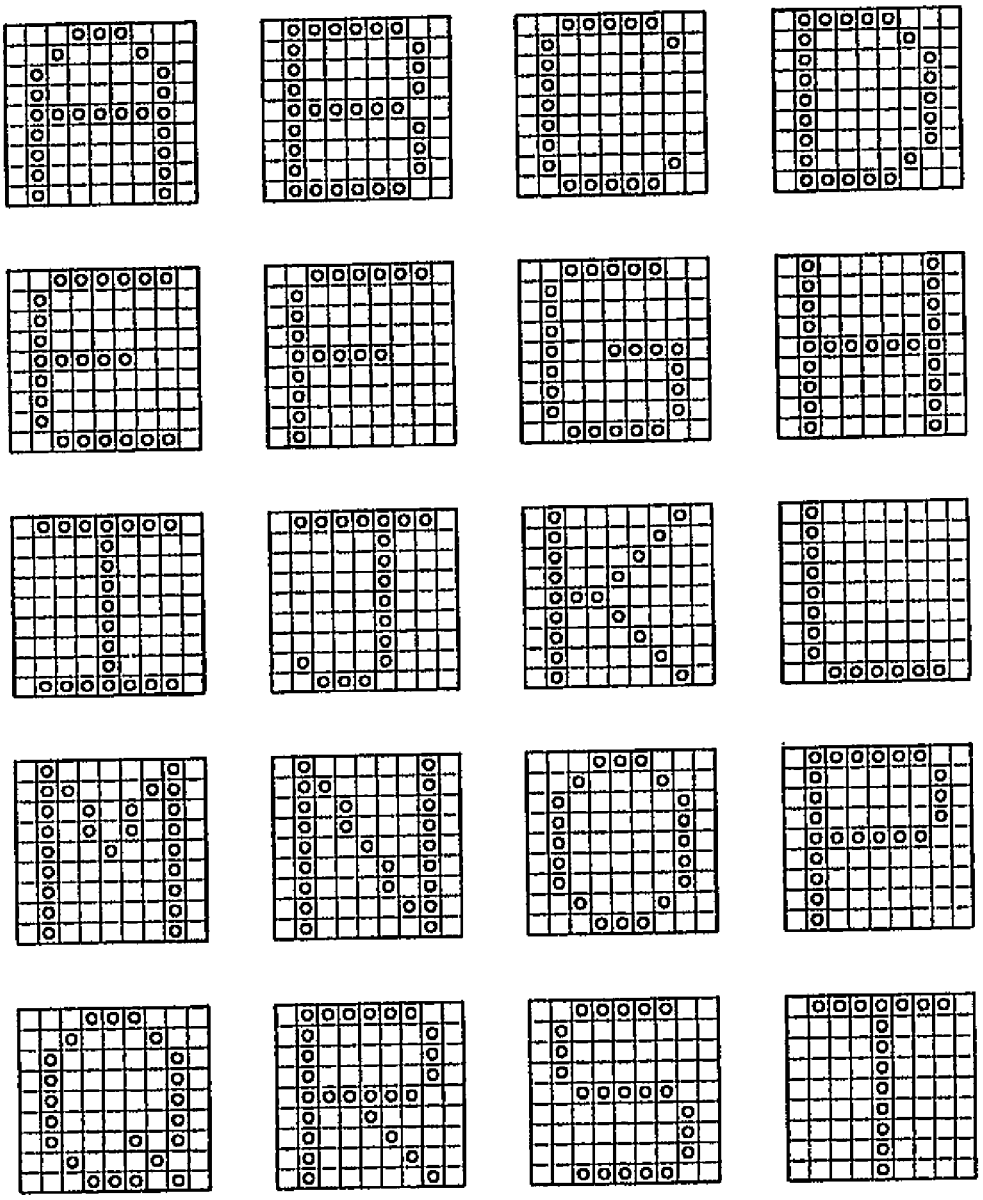
Figure 12B:
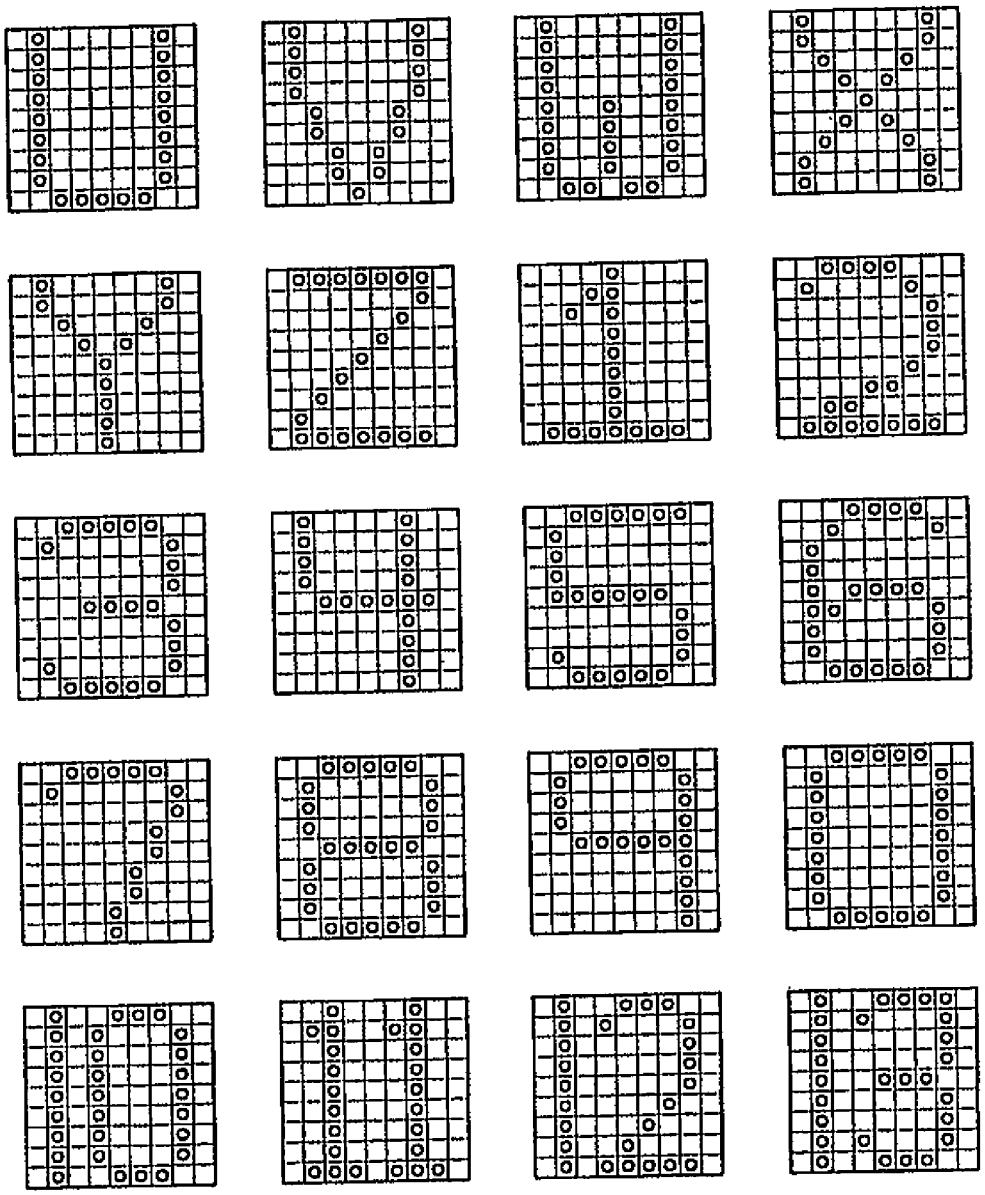
Figure 12C:
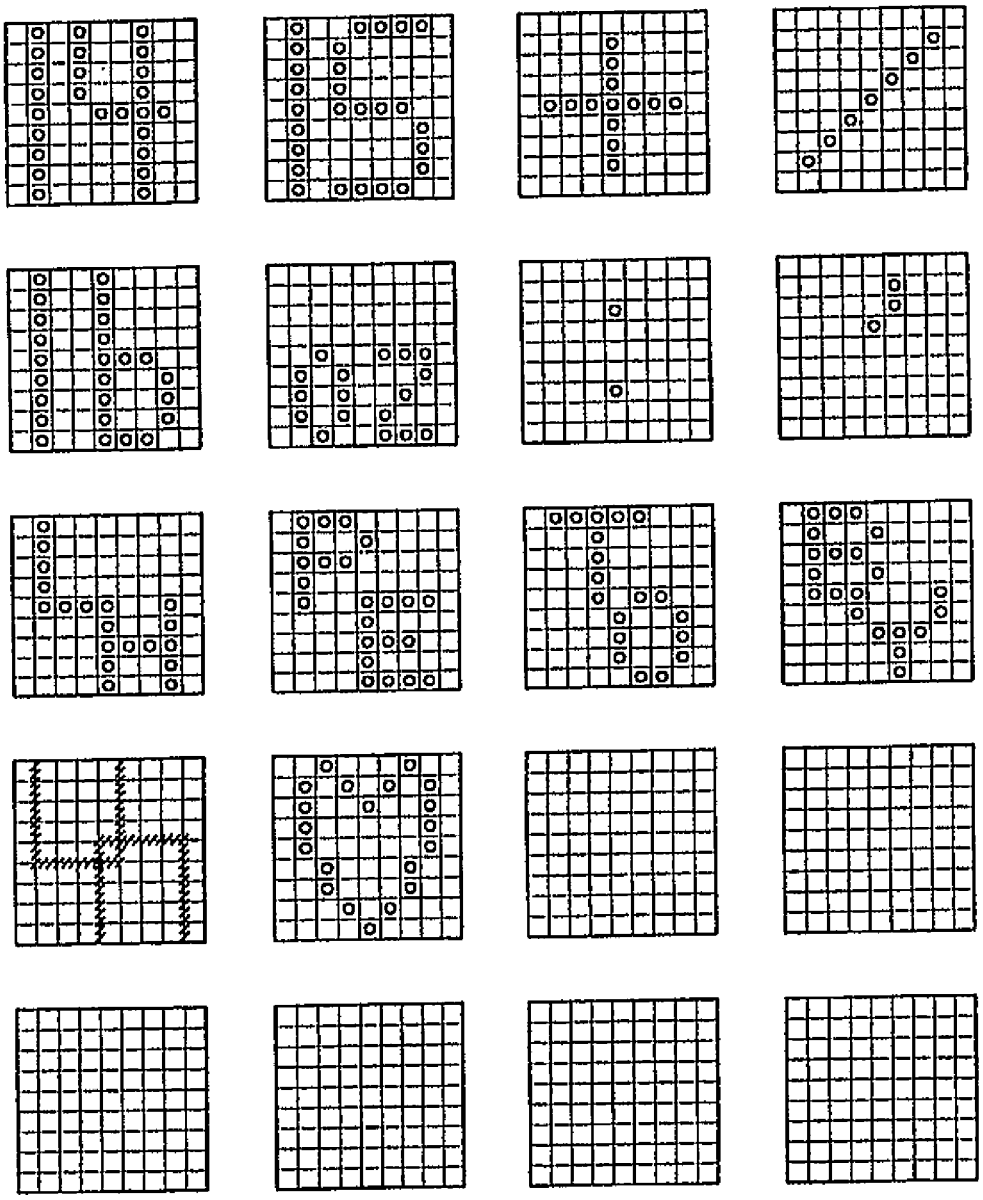
Figure 1:
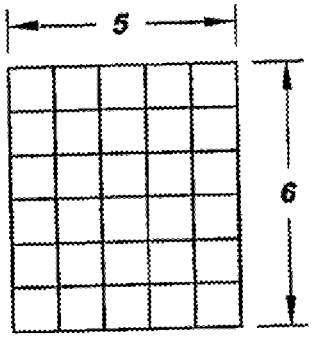
Figure 2A:
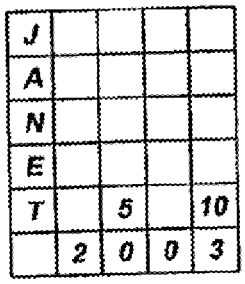
Figure 2B:
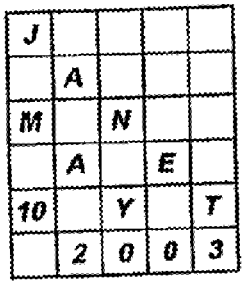
Figure 3:
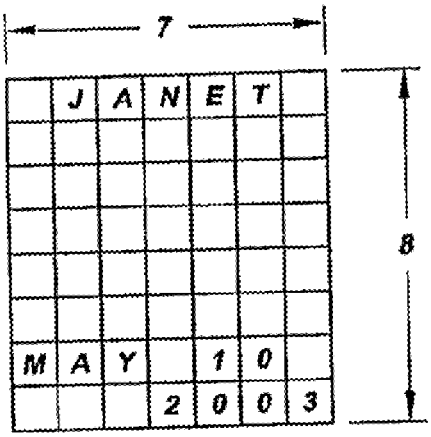
Figure 4A:
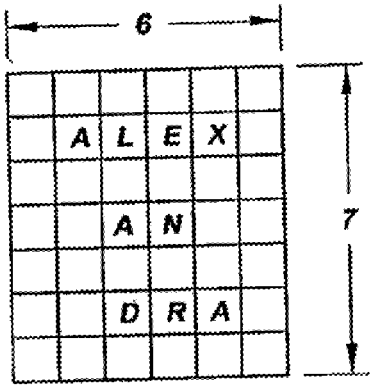
Figure 4B:
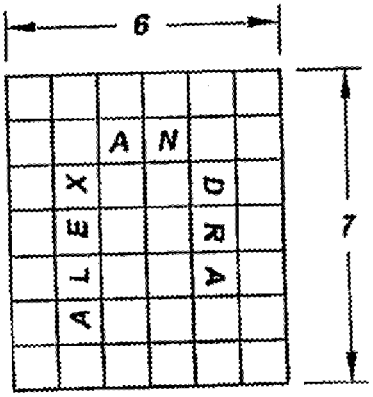
Figure 4C:
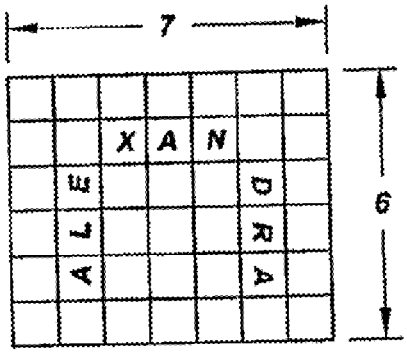
Figure 4D:
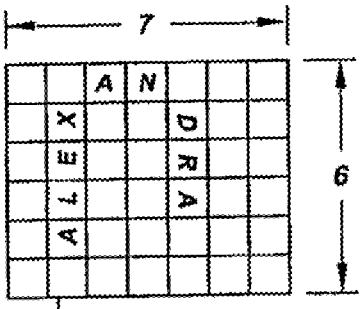
Figure 5A:
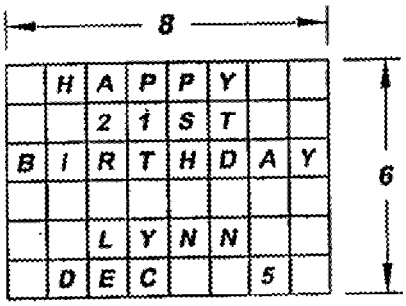
Figure 5B:
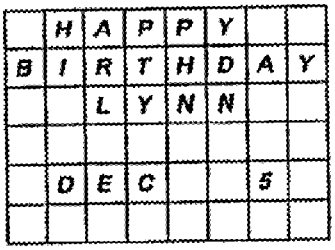
Figure 5C:
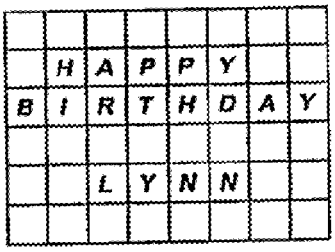
Figure 5D:
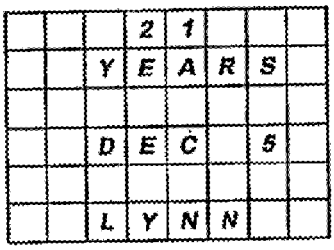
Figure 5E:
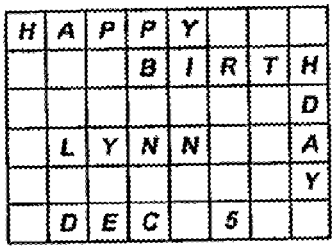
Figure 5F:
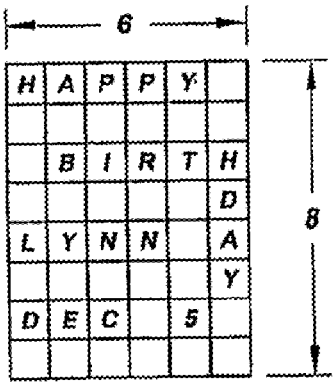
Figure 6:
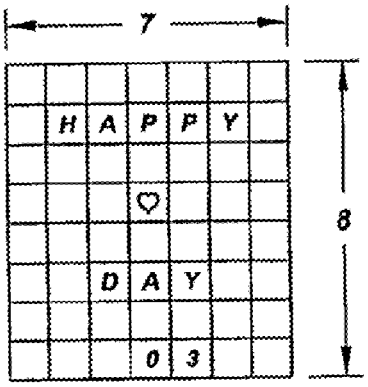
Figure 7:
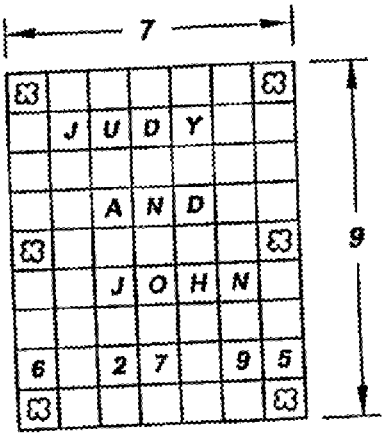
Figure 8A:
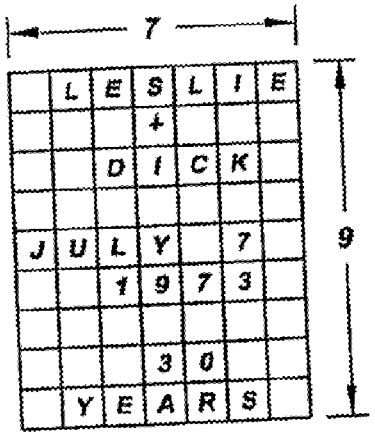
Figure 8B:
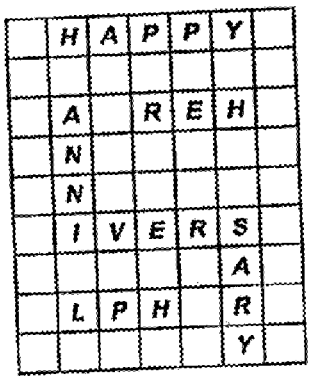
Figure 8C:
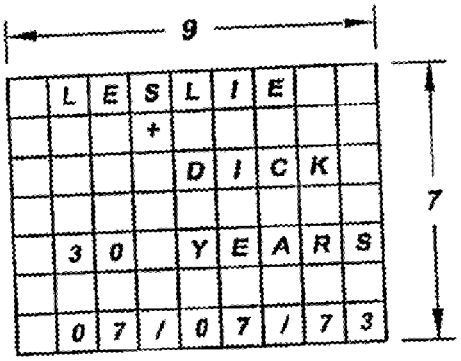
Figure 9:
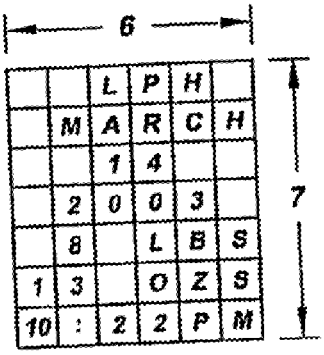
Figure 10A:
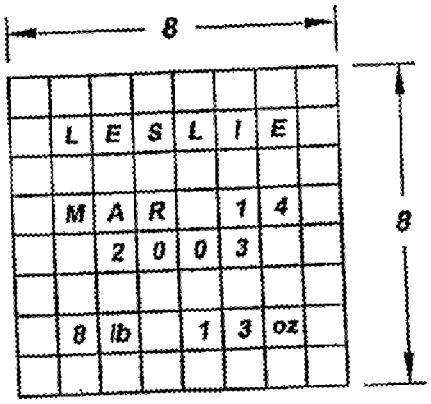
Figure 10B:
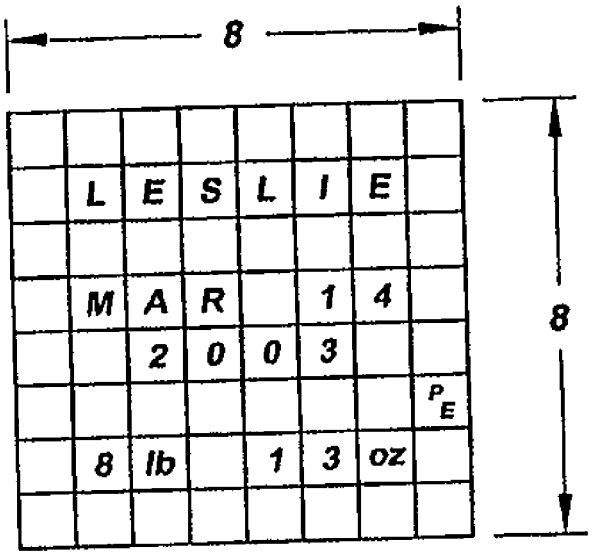
Figure 11:
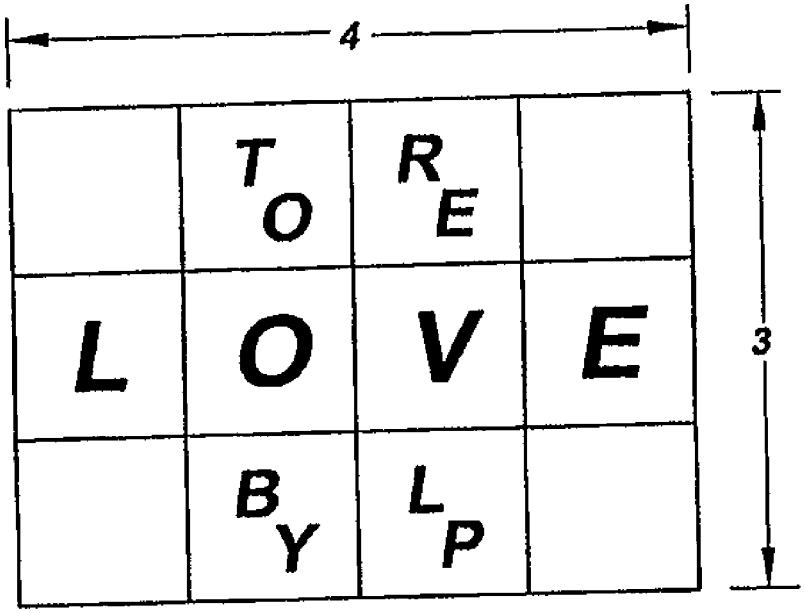
Figure 12A:
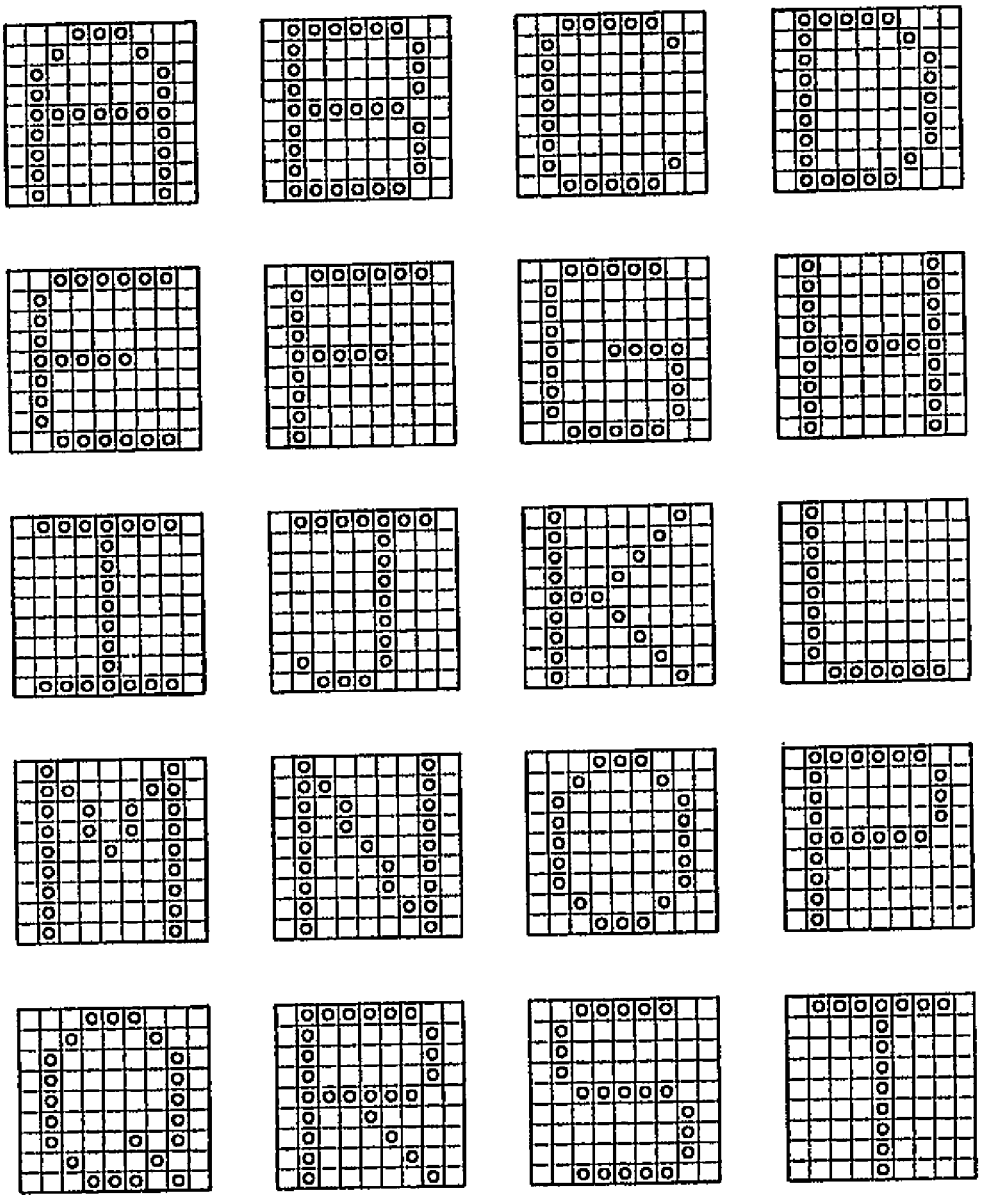
Figure 12B:
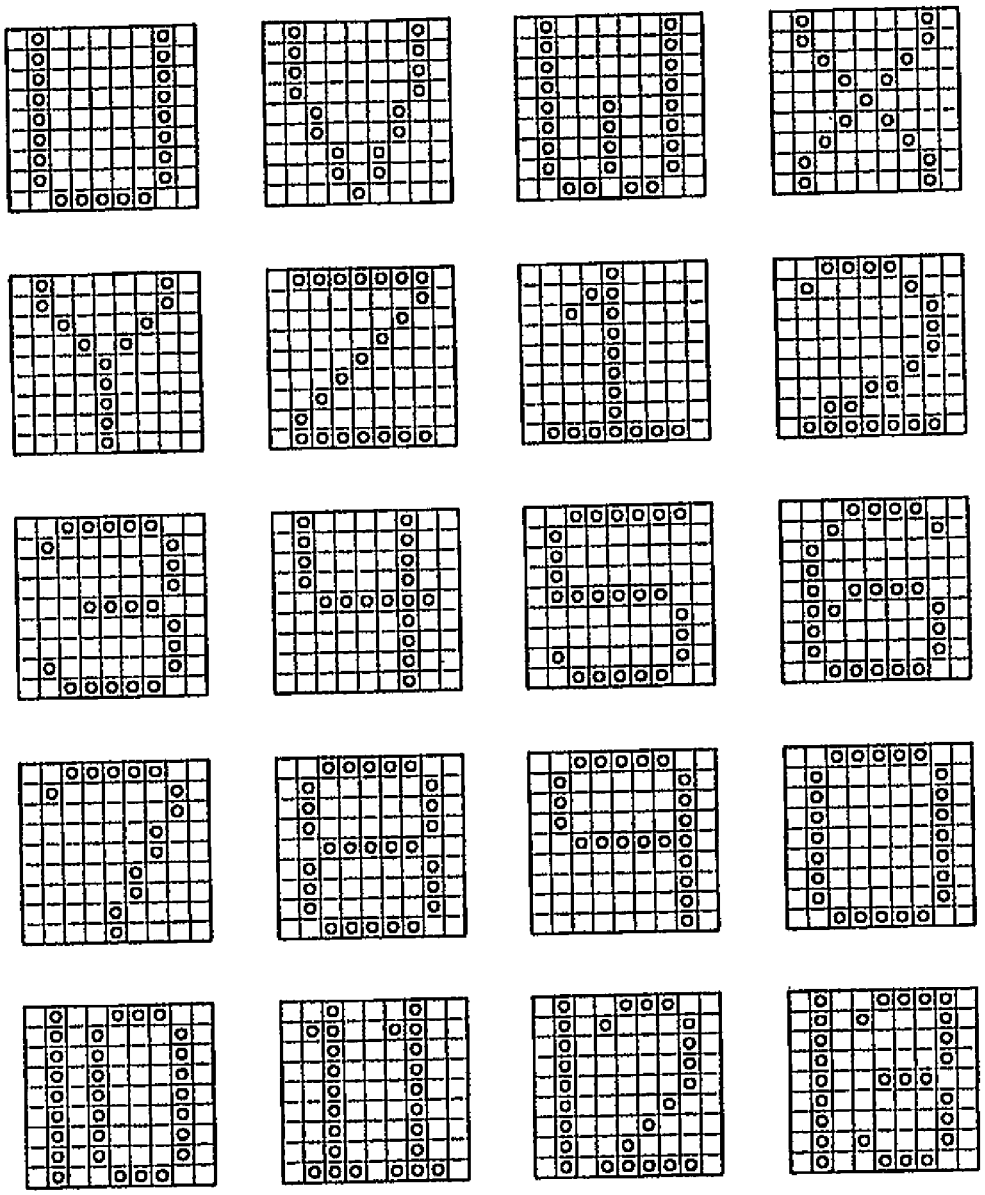
Figure 12C:
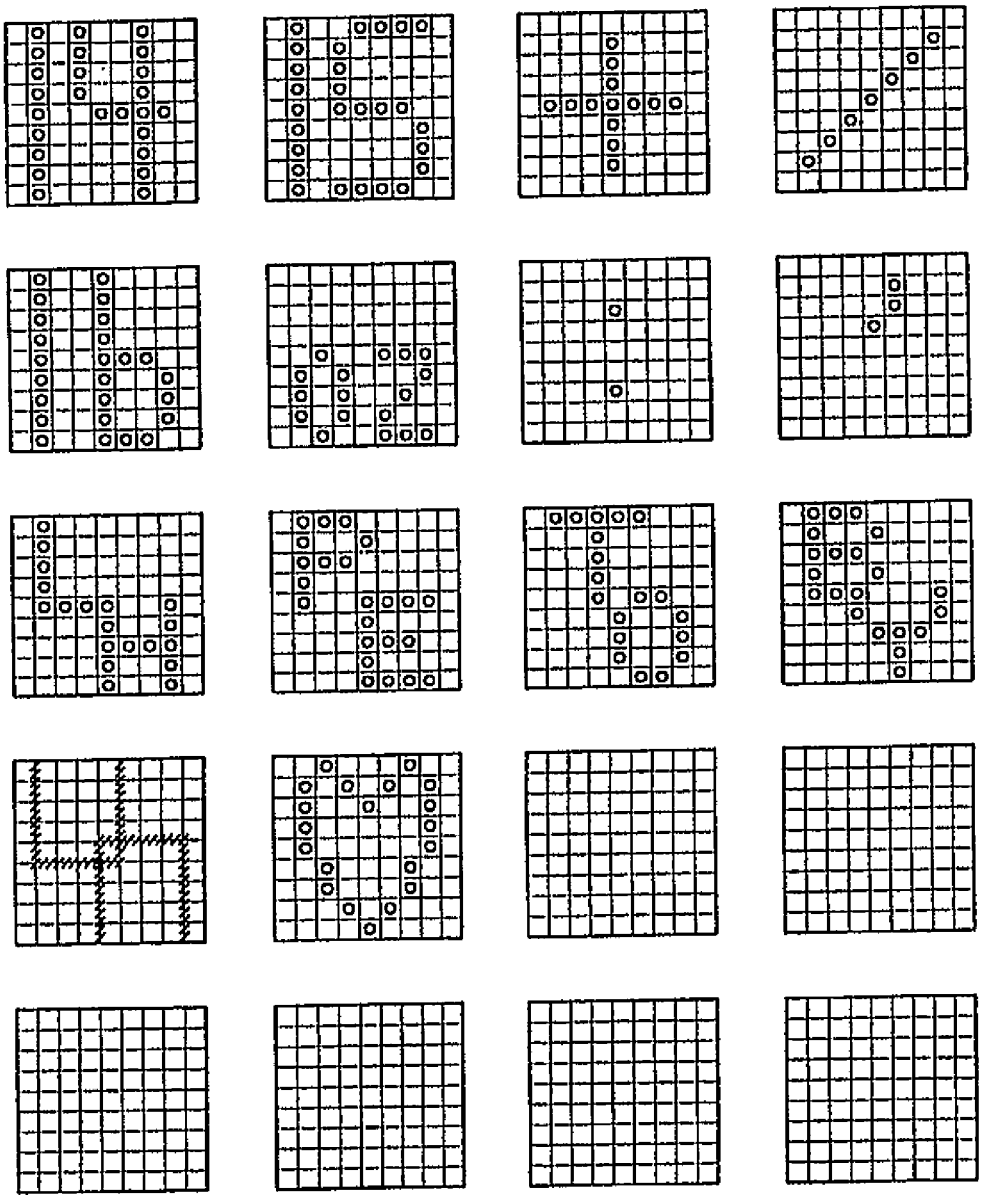

The individual squares may now be constructed. Some fabricators may wish to make the blank squares first, while others may prefer to make the squares with the indicia and designs or symbols first. In making the squares with the indicia, special grids such as those illustrated in FIGS. 12A through 12C may be utilized for the inclusion of the individual characters into the squares. These grids may provide examples of all of the letters in the alphabet and the numbers from 0 to 9 in block form. Other characters, often used combinations and abbreviations, as well as design elements may also be included in such grids. The grids may show where to put the stitches of contrasting color when forming the characters of the commemorative indicia within each individual square as the square is being fabricated. Such grids may be constructed by the fabricator. Other font styles and a variety of other characters and design elements may be selected at the discretion of the fabricator.

When all of the squares have been completed, the next step may be to connect all of the squares together according to the design grid produced earlier. This may be accomplished by sewing the squares together or by crocheting them together some fabricators may choose to further embellish the afghan. The fabricator may crochet a border along two opposing sides or around the entire perimeter of the afghan. A fringe may be added along two opposing sides or tassels may be attached at the four corners. The fringe or tassels may be attached after a border is added or instead of a border.

When the afghan is completed, a special label may be sewn on the afghan to indicate the name of the fabricator and/or any special instructions as to the laundering or cleaning of the afghan.

By following the foregoing steps, afghans commemorating any occasion may be fabricated. There has been no mention of specific knitting or crocheting instructions within the prior discussion because anyone wishing to fabricate an afghan incorporating special indicia may have previous knowledge of the craft and may follow such method and stitches within the fabricator's own familiarity.

A person of lesser skills may obtain a set of instructions for the fabrication of an afghan selected according to the skills possessed. A design grid may then be constructed based on the number and arrangement of the squares as set forth in those instructions. The selected indicia may then be fitted into this grid as described above. Special grids such as those shown in FIGS. 12A–C may be used as a guide to incorporate the chosen characters into the squares. The instructions may also indicate the quantities and types of yarn as well as the correct implement needed to make the afghan. If such instructions are used, care must be taken to purchase any additional quantities and colors of yarn for use in the incorporation of the selected indicia.

While two embodiments of the present invention have been illustrated and described in detail, it is to be understood that this invention is not limited thereto and may be otherwise practiced within the scope of the following claims.

I claim:

1. A method of fabricating an afghan incorporating personalized or commemorative indicia at the point of fabrication and being of a type composed of a plurality of individual pieces that are fabricated separately and then joined together to form a cohesive whole, said method comprising the steps of:

selecting a person or event which the afghan will commemorate;

selecting the specific indicia to form a message of the afghan;

choosing characters that make up the specific indicia so as to express the message to be incorporated into the afghan, said characters selected from the group consisting of letters, numerals and symbols;

anticipating the use for the completed afghan;

determining the size of the completed afghan;

selecting the size of the individual pieces of the afghan;

choosing the shape of the individual pieces of the afghan;

using the size of the completed afghan and the size of the individual pieces to calculate the number of individual pieces that will make up the completed afghan;

determining an arrangement of the individual pieces of the afghan with regard to the number of pieces in the horizontal direction and the number of pieces in the vertical direction;

formulating a first grid pattern wherein each unit of the first grid pattern represents one individual piece of the afghan and setting forth the same number of units in the horizontal direction and in the vertical direction so as to conform to the arrangement of the individual pieces in the completed afghan;

trying different arrangements of the characters within the first grid pattern until a desired arrangement is attained;

placing the chosen characters into the first grid pattern to represent the desired arrangement of the characters in the completed afghan;

selecting a method of fabrication of the afghan;

choosing specific stitches to be used to fabricate the afghan;

selecting a type of yarn to be used;

determining the size of fabricating implement needed;

selecting colors of the yarn to be used with consideration given to overall appearance, purpose, event commemorated, personal taste of the recipient, and contrast of the indicia;

determining the quantity of yarn of each color that will be required;

obtaining the necessary quantity of yarn and the fabricating implement needed;

obtaining a second grid pattern setting forth the positioning of each of the characters within one of the individual pieces of the afghan for use as a stitch by stitch guide in fabricating the individual pieces containing those characters;

fabricating the individual pieces that will make up the completed afghan using the second grid pattern for the incorporation of the chosen characters as the stitches are formed and using the first grid pattern to determine the number and nature of each of the individual pieces fabricated;

arranging the completed individual pieces according to the first grid pattern; and connecting the individual pieces together as indicated in the first grid pattern to form the completed afghan;

whereby the completed afghan contains the selected commemorative or personalized indicia arranged to form a cohesive, comprehensive and aesthetic whole.

2. The method of claim 1 further comprising the steps of fabricating a test piece using the selected type of yarn, implement and method of fabrication and making any adjustments necessary based on the measurements of the test piece to insure the completed afghan is the determined size.

3. The method of claim 1 wherein the shape of the individual pieces is selected from the group consisting of triangles, squares, rectangles, circles, hexagons, octagons and strips.

4. The method of claim 1 wherein the method of fabrication is selected from the group consisting of knitting, crocheting and Tunisian crochet.

5. An afghan containing personalized or commemorative indicia comprising:

a plurality of individually fabricated pieces of like shape and size, a first portion of said pieces each containing at least one character incorporated therewithin stitch by stitch at the point of fabrication, said characters selected from the group consisting of letters, numeral, and symbols, said first portion of pieces when arranged within the completed afghan forming specific personalized or commemorative indicia, and a second portion of said pieces being blank as to characters; means for arranging said pieces in side by side relation so as to best display said characters in the formation of the specific personalized or commemorative indicia within the completed afghan; and means for joining said pieces together while maintaining said arrangement, whereby the completed afghan exhibits the personalized or commemorative indicia in a cohesive comprehensive and aesthetic arrangement.

6. A method of fabricating an afghan incorporating personalized or commemorative indicia at the point of fabrication and being of a type composed of individual pieces that are fabricated separately and then joined together to form a cohesive whole, said method comprising the steps of:

selecting a person or event which the afghan will commemorate;

selecting the specific indicia to form the message of the afghan;

choosing characters that make up the specific indicia so as to express the message to be incorporated into the afghan, said characters selected from the group consisting of letters, numerals and symbols;

anticipating the use for the completed afghan;

selecting the size of the completed afghan;

obtaining a set of instructions for the fabrication of an afghan of the selected size, composed of a plurality of individual pieces, and setting forth a method of construction, arrangement of the individual pieces, type and quantity of yarn and implement needed;

formulating a first grid pattern wherein each unit of the grid pattern depicts one individual piece of the afghan, said grid pattern representing the number of units in the horizontal direction and in the vertical direction as set forth in the instructions and conforming to the arrangement of the individual pieces in the completed afghan;

trying different arrangements of the characters until a desired arrangement is attained;

placing the chosen characters into the first grid pattern to constitute the desired arrangement of the characters in the completed afghan such that the individual pieces containing the characters constitute a first portion of pieces and the remaining individual pieces constitute a second portion of pieces;

selecting the colors of the yarn to be used with consideration given to overall appearance, purpose, event commemorated, personal taste of the recipient, and contrast of the characters making up the specific indicia;

obtaining the necessary quantity of yarn and the implement as set forth in the instructions with consideration given to any additional yarn needed for the inclusion of the specific indicia;

obtaining a second grid pattern containing the positioning of the characters within each of the first portion of pieces for use as a stitch by stitch guide in fabricating the first portion of pieces;

fabricating the individual pieces that will make up the completed afghan following the instructions and the first grid pattern and using the second grid pattern to incorporate the chosen characters into the first portion of pieces;

arranging the completed individual pieces according to the first grid pattern; and connecting the individual pieces together as indicated in the first grid pattern to form the completed afghan;

whereby the completed afghan contains the desired commemorative or personalized indicia arranged in a cohesive, comprehensive and aesthetic whole.

7. A method of incorporating personalized or commemorative indicia into an afghan of a type composed of a plurality of individual pieces that are fabricated separately and then joined together to form a cohesive whole, the indicia being incorporated at the point of fabrication of the individual pieces, said method comprising the steps of:

selecting a person or event which the afghan will commemorate;

selecting the specific indicia to form a message of the afghan;

choosing characters that make up the specific indicia so as to express the message, said characters selected from the group consisting of letters, numerals, and symbols;

determining a number of the individual pieces of the afghan;

determining an arrangement of the individual pieces in the afghan with regard to the number of pieces in the horizontal direction and the number of pieces in the vertical direction;

formulating a first grid pattern wherein each unit of the grid pattern represents one individual piece of the afghan and setting forth the same number of units in the horizontal direction and in the vertical direction so as to conform to the arrangement of the individual pieces in the afghan;

trying different arrangements of the characters until a desired arrangement is attained;

placing the chosen characters into the first grid pattern to represent the desired arrangement of the indicia within the completed afghan;

using the first grid pattern designating as a first portion the individual pieces containing the characters and as a second portion the individual pieces that are blank as to characters; and obtaining a second grid pattern containing the positioning of each of the characters within each of the individual pieces of the first portion for use as a stitch by stitch guide in the fabrication of the first portion of the individual pieces;

whereby when all of the individual pieces of the afghan are fabricated, the individual pieces are arranged according to the first grid pattern and the individual pieces are joined together, the completed afghan contains the desired commemorative or personalized indicia set forth in a cohesive, comprehensive and aesthetic whole.

* * * * *

UNITED STATES PATENT AND TRADEMARK OFFICE

CERTIFICATE OF CORRECTION

PATENT NO. : 7,065,987 B2
APPLICATION NO. : 10/699285
DATED : June 27, 2006
INVENTOR(S) : Leslie Howe Henneberg It is certified that error appears in the above-identified patent and that said Letters Patent is hereby corrected as shown below:

Delete Figs. 1-Figs.12 C, and substitute therefor Figs. 1- Figs. 12 C,
As shown on attached pages.

Signed and Sealed this

Second Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 7,065,987 B2
APPLICATION NO. : 10/699285
DATED : June 27, 2006
INVENTOR(S) : Leslie Howe Henneberg It is certified that error appears in the above-identified patent and that said Letters Patent is hereby corrected as shown below:

Delete the title page and substitute therefor the attached title page.

Delete Figs. 1-Figs.12 C, and substitute therefor Figs. 1- Figs. 12 C,
As shown on attached pages.

This certificate supersedes Certificate of Correction issued October 2, 2007.

Signed and Sealed this

Thirtieth Day of October, 2007

JON W. DUDAS
*Director of the United States Patent and Trademark Office*

(12) United States Patent
Henneberg

(10) Patent No.: US 7,065,987 B2
(45) Date of Patent: Jun. 27, 2006

(54) HAND CRAFTED AFGHAN INCORPORATING PERSONALIZED OR COMMEMORATIVE INDICIA AND METHOD OF FABRICATING SAME

(76) Inventor: Leslie Howe Henneberg, 375 Eatontown Rd., Port Jervis, NY (US) 12771

( * ) Notice: Subject to any disclaimer, the term of this patent is extended or adjusted under 35 U.S.C. 154(b) by 299 days.

(21) Appl. No.: 10/699,285

(22) Filed: Oct. 31, 2003

(65) Prior Publication Data

US 2005/0115483 A1 Jun. 2, 2005

(51) Int. Cl.
*D04B 31/00* (2006.01)

(52) U.S. Cl. ..... 66/1 R; 66/170

(58) Field of Classification Search ..... 66/1 R, 66/170, 169 R

See application file for complete search history.

(56) References Cited

U.S. PATENT DOCUMENTS

| | | | | |
|---|---|---|---|---|
| 1,197,551 | A | 9/1916 | Schmidt | |
| D121,954 | S * | 8/1940 | Gorska | D6/603 |
| 2,299,300 | A * | 10/1942 | Bjoreson | 66/170 |
| 2,301,410 | A * | 11/1942 | Kaplan et al. | 434/95 |

(Continued)

OTHER PUBLICATIONS

Knitting Book copyright 1970 US and Canada Gottlieb Bros. N.Y. 10009.

(Continued)

*Primary Examiner*—Danny Worrell
(74) *Attorney, Agent, or Firm*—Sandra M. Kotin

(57) ABSTRACT

Disclosed herein is an afghan incorporating personalized or commemorative indicia and a method for constructing the afghan. The individual pieces of the afghan incorporate the characters and symbols of the indicia at the point of fabrication so that the afghan is complete when the pieces are joined together. The method involves determining the event to be commemorated, choosing the specific indicia to be incorporated into the afghan and anticipating the use for the completed afghan. The size of the afghan and of the individual pieces are determined as well as the number of pieces to be fabricated. A grid is constructed representing the number and arrangement of the pieces so that the characters and symbols making up the indicia may be suitably positioned within the grid and within the completed afghan to provide the most esthetic result. The craft method is then chosen as well as the type and colors of the yarn and the implement or implements needed in the fabrication. A test piece is fabricated and the quantity of yarn of each color is determined. The individual pieces are fabricated, properly arranged according to the grid, and joined together.

7 Claims, 7 Drawing Sheets

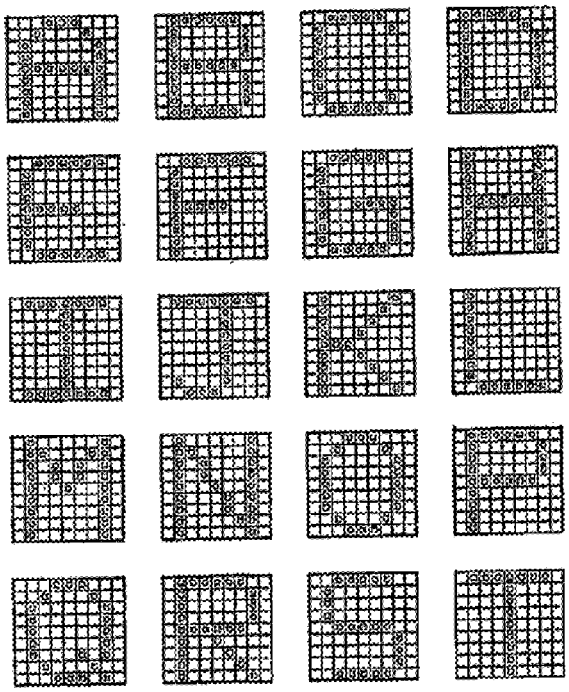

UNITED STATES PATENT AND TRADEMARK OFFICE

CERTIFICATE OF CORRECTION

PATENT NO. : 7,065,987 B2
APPLICATION NO. : 10/699285
DATED : June 27, 2006
INVENTOR(S) : Leslie Howe Henneberg It is certified that error appears in the above-identified patent and that said Letters Patent is hereby corrected as shown below:

Delete the title page and substitute therefor the attached title page.

Delete Figs. 1-Figs.12 C, and substitute therefor Figs. 1- Figs. 12 C,
As shown on attached pages.

This certificate supersedes Certificates of Correction issued October 2, 2007 and October 30, 2007.

Signed and Sealed this

Twentieth Day of November, 2007

JON W. DUDAS
*Director of the United States Patent and Trademark Office*

(12) United States Patent
Henneberg

(10) Patent No.: US 7,065,987 B2
(45) Date of Patent: Jun. 27, 2006

(54) HAND CRAFTED AFGHAN INCORPORATING PERSONALIZED OR COMMEMORATIVE INDICIA AND METHOD OF FABRICATING SAME

(76) Inventor: Leslie Howe Henneberg, 375 Eatontown Rd., Port Jervis, NY (US) 12771

( * ) Notice: Subject to any disclaimer, the term of this patent is extended or adjusted under 35 U.S.C. 154(b) by 299 days.

(21) Appl. No.: 10/699,285

(22) Filed: Oct. 31, 2003

(65) Prior Publication Data

US 2005/0115483 A1 Jun. 2, 2005

(51) Int. Cl.
*D04B 31/00* (2006.01)

(52) U.S. Cl. ..... 66/1 R; 66/170

(58) Field of Classification Search ..... 66/1 R, 66/170, 169 R

See application file for complete search history.

(56) References Cited

U.S. PATENT DOCUMENTS

| | | | | |
|---|---|---|---|---|
| 1,197,551 | A | 9/1916 | Schmidt | |
| D121,954 | S * | 8/1940 | Gorska | D6/603 |
| 2,299,300 | A * | 10/1942 | Bjoreson | 66/170 |
| 2,301,410 | A * | 11/1942 | Kaplan et al. | 434/95 |

(Continued)

OTHER PUBLICATIONS

Knitting Book copyright 1970 US and Canada Gottlieb Bros. N.Y. 10009.

(Continued)

*Primary Examiner*—Danny Worrell
(74) *Attorney, Agent, or Firm*—Sandra M. Kotin

(57) ABSTRACT

Disclosed herein is an afghan incorporating personalized or commemorative indicia and a method for constructing the afghan. The individual pieces of the afghan incorporate the characters and symbols of the indicia at the point of fabrication so that the afghan is complete when the pieces are joined together. The method involves determining the event to be commemorated, choosing the specific indicia to be incorporated into the afghan and anticipating the use for the completed afghan. The size of the afghan and of the individual pieces are determined as well as the number of pieces to be fabricated. A grid is constructed representing the number and arrangement of the pieces so that the characters and symbols making up the indicia may be suitably positioned within the grid and within the completed afghan to provide the most esthetic result. The craft method is then chosen as well as the type and colors of the yarn and the implement or implements needed in the fabrication. A test piece is fabricated and the quantity of yarn of each color is determined. The individual pieces are fabricated, properly arranged according to the grid, and joined together.

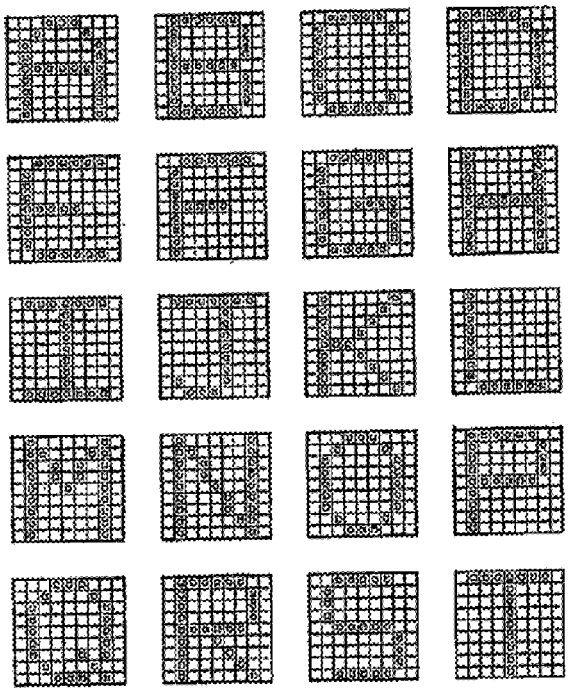

7 Claims, 7 Drawing Sheets